US007422298B2

(12) United States Patent
Ueda

(10) Patent No.: US 7,422,298 B2
(45) Date of Patent: Sep. 9, 2008

(54) INKJET RECORDING APPARATUS AND RECORDING METHOD

(75) Inventor: Masashi Ueda, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 407 days.

(21) Appl. No.: 11/190,121

(22) Filed: Jul. 27, 2005

(65) Prior Publication Data

US 2006/0023014 A1 Feb. 2, 2006

(30) Foreign Application Priority Data

Jul. 28, 2004 (JP) ..... 2004-220775

(51) Int. Cl.
*B41J 29/38* (2006.01)

(52) U.S. Cl. ..... 347/5; 347/16

(58) Field of Classification Search ..... 347/16, 347/41, 5

See application file for complete search history.

(56) References Cited

U.S. PATENT DOCUMENTS 6,793,304 B2 * 9/2004 Kasahara ..... 347/5
2002/0075339 A1 * 6/2002 Kamoshida et al. ..... 347/12

FOREIGN PATENT DOCUMENTS

EP 0 876 920 11/1998
EP 0 925 950 6/1999
JP 10-3378/63 A 12/1998
JP 2000015867 1/2000
JP 2004-083281 A 3/2004

OTHER PUBLICATIONS

Fine Imaging and Hardcopy, Jan. 7, 1999, pp. 506-535, Corona Publishing Co., Ltd., Tokyo, Japan.
JP Office Action dtd. Jun. 25, 2007, JP Appln. 2004-220775.

* cited by examiner

*Primary Examiner*—Julian D. Huffman
*Assistant Examiner*—Jason S Uhlenhake
(74) *Attorney, Agent, or Firm*—Banner & Witcoff, Ltd.

(57) ABSTRACT

An inkjet recording apparatus includes a recording head having a nozzle row aligned with a plurality of nozzles and a carrying mechanism capable of carrying a record medium by a multiple of an arbitrary natural number of a unit carry amount in a direction in parallel with the nozzle row. The record medium is carried by any of quasi logical carry amounts including a natural number larger than a logical carry amount determined based on a recording resolution and a number of nozzles and represented as a multiple of the unit carry amount and a natural number smaller than the logical carry amount. The record medium is recorded at each time of carrying the record medium. A carry amount of the record medium is determined such that a difference between the logical carry amount and an actual carry amount of the record medium does not exceed a predetermined value.

8 Claims, 18 Drawing Sheets

FIG. 6

| LOGICAL CARRY AMOUNT P [PULSE] | FIRST QUASI LOGICAL CARRY AMOUT P1 [PULSE] | SECOND QUASI LOGICAL CARRY AMOUT P2 [PULSE] |
|---|---|---|
| 1 < P< 2 | 1 | 2 |
| ⋮ | ⋮ | ⋮ |
| 10 < P< 11 | 10 | 11 |
| 11 < P< 12 | 11 | 12 |
| 12 < P< 13 | 12 | 13 |
| 13 < P< 14 | 13 | 14 |
| 14 < P< 15 | 14 | 15 |
| 15 < P< 16 | 15 | 16 |
| ⋮ | ⋮ | ⋮ |
| 18 < P< 19 | 18 | 19 |

FIG. 7

| RECORDING RESOLUTION d [dpi] | NECESSARY PASS NUMBER [TIME] | LOGICAL CARRY AMOUNT P [PULSE] |
|---|---|---|
| 6,000 | 80 | 15.6 |
| 5,025 | 67 | 18.63 |
| 2,400 | 32 | 39 |
| 1,200 | 16 | 78 |
| 600 | 8 | 156 |
| 300 | 4 | 312 |
| 150 | 2 | 624 |

FIG. 8

| LOGICAL CARRY AMOUNT P [PULSE] | FIRST QUASI LOGICAL CARRY AMOUT P1 [PULSE] | SECOND QUASI LOGICAL CARRY AMOUT P2 [PULSE] |
|---|---|---|
| 15.6 | 15 | 16 |
| 18.63 | 18 | 19 |

FIG. 16

| CARRY NUMBER OF TIMES N [TIME] | CARRY AMOUNT T BY WHICH SHEET IS TO BE CARRIED [PULSE] | CARRY AMOUNT (SET CARRY AMOUNT) R BY WHICH SHEET IS ACTUALLY CARRIED [PULSE] | DIFFERENCE S [PULSE] |
|---|---|---|---|
| 1 | 15.6 | 15 | 0.6 |
| 2 | 16.2 | 16 | 0.2 |
| 3 | 15.8 | 15 | 0.8 |
| 4 | 16.4 | 16 | 0.4 |
| 5 | 16 | 16 | 0 |
| 6 | 15.6 | 15 | 0.6 |
| 7 | 16.2 | 16 | 0.2 |
| 8 | 15.8 | 15 | 8 |
| 9 | 16.4 | 16 | 0.4 |
| 10 | 16 | 16 | 0 |
| 11 | 15.6 | 15 | 0.6 |
| 12 | 16.2 | 16 | 0.2 |
| 13 | 15.8 | 15 | 0.8 |
| ⋮ | ⋮ | ⋮ | ⋮ |

FIG. 18
$$M = \begin{Bmatrix} M_1 \\ M_2 \\ M_3 \\ M_4 \\ M_5 \end{Bmatrix} = \begin{Bmatrix} 1, 0, 0, 0, 0 \\ 0, 0, 1, 0, 0 \\ 0, 0, 0, 0, 1 \\ 0, 1, 0, 0, 0 \\ 0, 0, 0, 1, 0 \end{Bmatrix}$$
FIG. 17A
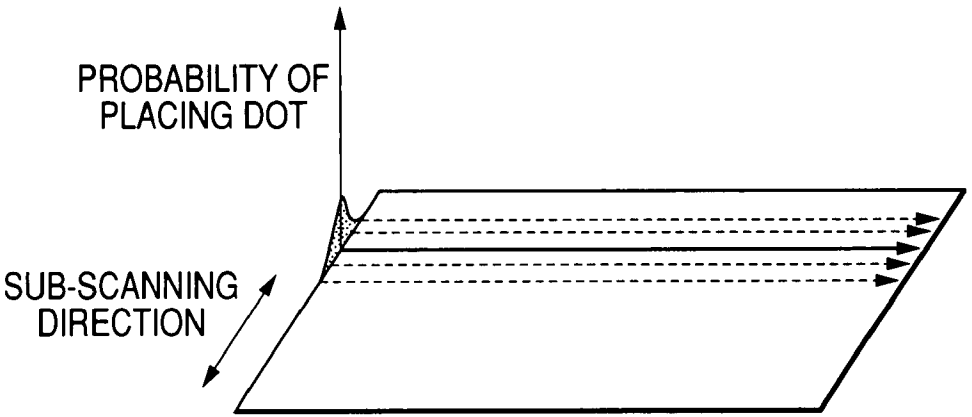
FIG. 17B
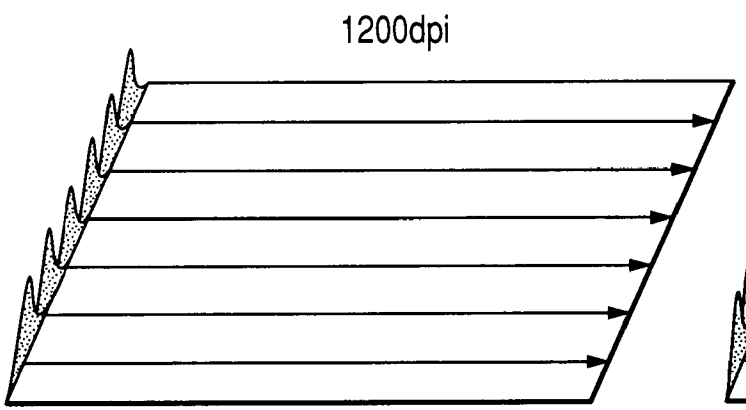
FIG. 17C
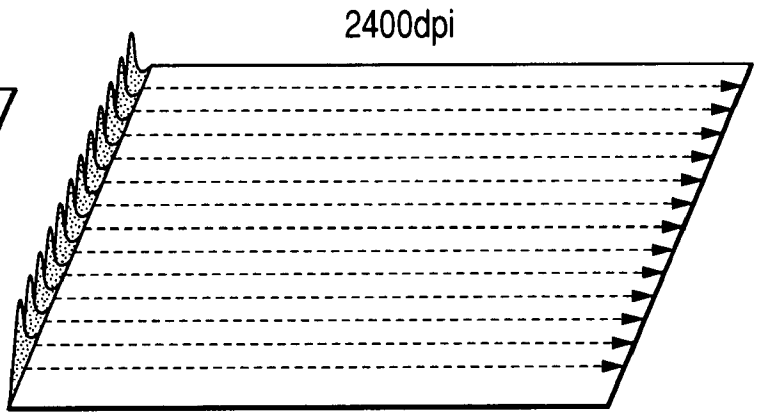

INKJET RECORDING APPARATUS AND RECORDING METHOD

BACKGROUND OF THE INVENTION

1. Field of the Invention

The present invention relates to an inkjet recording apparatus which performs recording on a record medium that is carried in a direction in parallel with a direction of aligning nozzles by a recording head formed with the nozzles, and to a recording method for use in the inkjet recording apparatus.

2. Description of the Related Art

There is known an inkjet recording apparatus that performs recording by ejecting ink to a record sheet. As the inkjet recording apparatus, a serial type in which a recording head having a nozzle row aligned with a plurality of nozzles for ejecting ink in one direction at a constant pitch (pitch corresponding to nozzle resolution) is attached to a carriage reciprocated in a direction orthogonal to the nozzle aligning direction is generally used. As disclosed in JP-A-2000-15867, according to the inkjet recording apparatus of the serial type, a recording mechanism carries a record sheet in a nozzle aligning direction (hereinafter, referred to as "sub-scanning direction") in synchronism with reciprocating the carriage in a direction orthogonal to the nozzle aligning direction (hereinafter, referred to as "main scanning direction"). In this case, the carrying mechanism can carry the record sheet in the sub-scanning direction by a unit carrying amount constituting a minimum carrying amount thereof (for example, a carrying amount corresponding to 2400[dpi]) multiplied by a natural number.

SUMMARY OF THE INVENTION

When a record sheet is recorded by using the above-described inkjet recording apparatus, if the sheet carrying resolution (hereinafter, referred to as "recording resolution") in the sub-scanning direction by the carrying mechanism is increased, the record sheet can be recorded with the higher image quality such that a cross streak (also called as "banding") is prevented from being brought about. Further, since an image is formed by driving the nozzle in the main scanning direction while carrying the record sheet in the sub-scanning direction, the recording resolution in the sub-scanning direction becomes to be the nozzle resolution multiplied by a natural number. Actually, it is general to prepare a plurality of record resolutions such that a user can pertinently select a desired recording resolution from various recording resolutions. Furthermore, even when the plurality of recording resolutions are prepared in this way, in order to reduce costs for manufacturing the whole apparatus, it is general to use the same part for a sensor of an encoder or the like for controlling an accuracy of carrying by the carrying mechanism. Therefore, a minimum resolution of a carrying function which can be controlled by utilizing the encoder or the like (that is, an inverse number of the unit carrying amount and is hereinafter referred to as "unit carrying resolution") is related to the plurality of recording resolutions to be a value of a least common multiple of the plurality of recording resolutions multiplied by a natural number. Further, in order to prevent the above-described least common multiple from being considerably a large value, a plurality of recording resolutions are set to be values multiplied by an exponent of 2 thereamong.

Specifically, there is a case in which with respect to the nozzle resolution of 75[dpi], the recording resolution in the sub-scanning direction is set to 150[dpi] that is 2 times of 75[dpi], 300[dpi] that is 4 times of 75[dpi], 600[dpi] that is 8 times of 75[dpi], and 1,200[dpi] that is 16 times of 75[dpi]. Further, the unit carrying resolution of the encoder or the like at this occasion is set to 6,000[dpi] that is 5 times of a least common multiple of 1,200[dpi] of the respective recording resolutions.

Assuming that there is not the above-described relationship (relationship of being multiplied by an exponent of 2) (when, for example, 750[dpi] that is 10 times of a nozzle resolution, 2,400[dpi] that is 32 times thereof, and 6,000[dpi] that is 80 times thereof are mixed as recording resolutions in the sub-scanning direction), a minimum common multiple thereof becomes 480,000[dpi] to reach a level at which a mechanism of achieving the accuracy cannot be constructed in fact.

Therefore, in a product of a related art, there are frequently cases in which only resolutions in the sub-scanning direction having a relationship of being multiplied by an exponent of 2 can be selected.

Further, the above-described restriction also brings about a drawback as follows. When a higher resolution is needed in order to promote an image quality, the resolution is obliged to be 2 times of the highest recording resolution in a current state. Further, when the highest recording resolution becomes 2 times of the resolution, a unit carrying resolution in the carrying mechanism also needs to be multiplied by 2 in accordance therewith. However, the carrying mechanism having the high unit carrying resolution constitutes a factor of high cost.

Further, assuming that a time period necessary for one time main scanning recording stays the same, a carrying time period in the sub-scanning direction is needed by twice as much as a time period necessary for recording simply. Therefore, when it is assumed that a time period necessary for recording an image on one sheet of A4 size by the current maximum recording resolution is 2 minutes, in the case of doubling the recording resolution, 4 minutes are needed and a long period of time is required until finishing to record an image.

On the other hand, it is said that perception and sensitivity of human being execute logarithmic response to a stimulating amount. That is, even a time period of recording an image is doubled, the human being does not frequently regard that the image quality is improved double-fold. In this way, the sensitivity of the human being is frequently ambiguous. Therefore, as a trade-off design of the image quality and the recording time period in implementing a product, it is intended to delicately adjust the both factors, however, in the related art, it is necessary to provide the resolution in the sub-scanning direction with a value of an exponent of 2 and therefore, such a delicate adjustment cannot be carried out.

The present invention provides an inkjet recording apparatus being capable of using a recording resolution that can realize to record with a high image quality without bringing about high cost for producing a carrying mechanism and without considerably reducing a recording speed.

According to one aspect of the invention, there is provided an inkjet recording apparatus including: a recording head having a nozzle row aligned with a plurality of nozzles for ejecting ink; a carrying mechanism being capable of carrying a record medium by a multiple of an arbitrary natural number of a unit carrying amount in a direction in parallel with the nozzle row; a carry controlling unit that controls the carrying mechanism such that the record medium is carried by any of a plurality of quasi logical carry amounts including a natural number larger than a logical carry amount, which is determined based on a recording resolution along the direction in parallel with the nozzle row and a number of nozzles that are used for recording in the nozzle row and is indicated as a multiple of the unit carrying amount, and a natural number smaller than the logical carry amount; and a recording head controlling unit that controls the recording head such that the record medium is recorded at each time of carrying the record medium by the carrying mechanism that is controlled by the carry controlling unit. The carry controlling unit determines a carry amount of the record medium by the carrying mechanism from the plurality of quasi logical carry amounts such that a difference between a carry amount when the record medium is assumed to be carried by the logical carry amount and an actual carry amount of the record medium does not exceed a predetermined value.

According to another aspect of the invention, there is provided a recording method for use in an inkjet recording apparatus including a recording head having a nozzle row aligned with a plurality of nozzles for ejecting ink, and a carrying mechanism being capable of carrying a record medium by a multiple of an arbitrary natural number of a unit carry amount in a direction in parallel with the nozzle row, the recording method including: carrying the record medium by a single or a plurality of times by the carrying mechanism by any of a plurality of quasi logical carry amounts including a natural number larger than a logical carry amount, which is determined based on a recording resolution along the direction in parallel with the nozzle row and a number of the nozzles that are used for recording in the nozzle row and is indicating a rate relative to the unit carry amount in the carrying mechanism, and a natural number smaller than the logical carry amount; and recording the record medium by the recording head after the carrying. In the carrying, the record medium is carried by a carry amount such that a difference between a carry amount by which the record medium is assumed to be carried by the logical carry amount and an actual carry amount of the record medium does not exceed a predetermined value.

According to the aspects of the invention, recording can be executed without constituting the recording resolution by a multiple of the unit carrying resolution. Therefore, the recording resolution capable of realizing high image quality recording can be used without using a carrying mechanism at high cost having a high unit carrying resolution and without considerably reducing a recording speed. Further, since the recording resolution may not be a multiple of the unit carrying resolution, a relationship of a multiple of an exponent of 2 may not be provided between the resolutions. Therefore, a delicate balance can be adjusted between a printing time period and an improvement in an image quality and a product specification having excellent handling performance for a user can be proposed.

BRIEF DESCRIPTION OF THE DRAWINGS

The present invention may be more readily described with reference to the accompanying drawings:

FIG. 6 shows data stored to a carry amount corresponding data storing portion;

FIG. 7 shows data stored to a logical carry amount storing portion;

FIG. 8 shows data stored to a quasi logical carry amount storing portion;

FIG. 16 shows data indicating a difference between the logical carry amount and an amount by which a sheet is actually carried which are related to a number of times of carrying the sheet;

FIGS. 17A to 17C illustrate views showing a relationship between a shift of a position of a dot and production of a gap;

FIG. 18 is an explanatory view showing a matrix used in the dot data converting processing;

DETAILED DESCRIPTION OF THE PREFERRED EMBODIMENTS

An explanation will be given of a first embodiment and a second embodiment of an inkjet recording apparatus according to the invention with reference to the drawings as follows.

Figure 1:
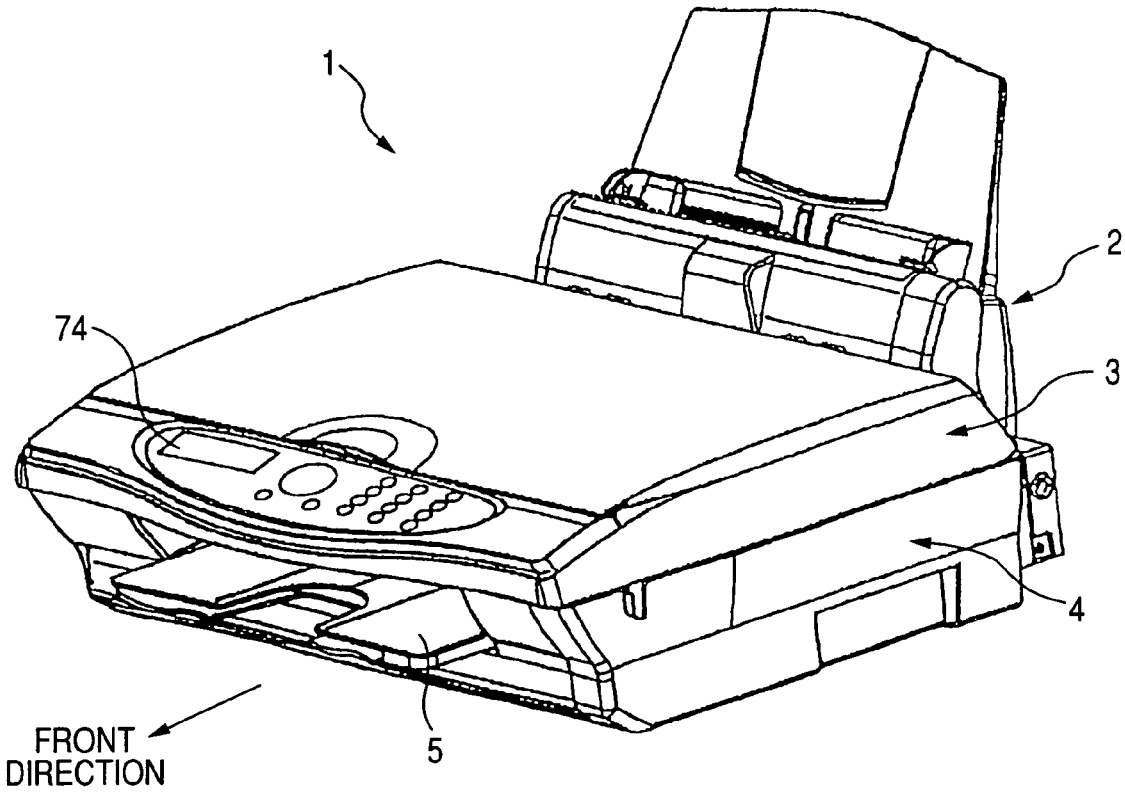
FIG. 1 is a perspective view showing a constitution of a multifunction machine.

First, a total constitution of a multifunction machine according to the first embodiment will be described in reference to FIG. 1. A multifunction machine 1 is provided with a sheet feeding apparatus 2 at a rear end portion thereof, provided with an original reading apparatus 3 for a copy function or the like on an upper side of a front side of the sheet feeding apparatus 2, and is provided with an inkjet printer (inkjet recording apparatus) 4 for realizing a printer function or the like at a total of a lower side of the draft reading apparatus 3. A front side of the inkjet printer 4 is provided with a sheet discharging table 5 for a sheet recorded with an image. Further, an upper face of a front side of the inkjet printer 4 is provided with LCD 74 capable of displaying set information or the like.

Figure 2:
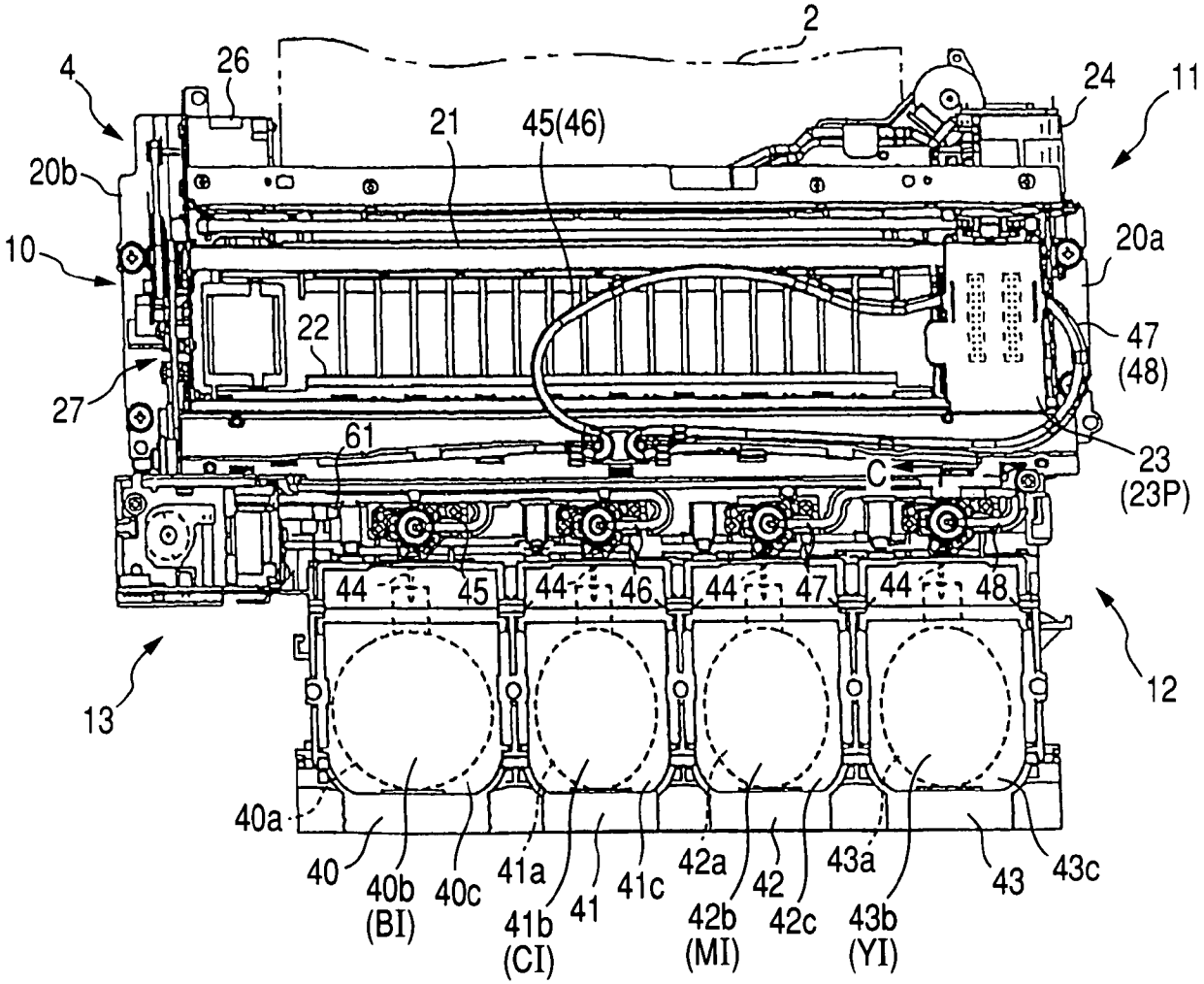
FIG. 2 is an explanatory view showing a constitution of an inkjet printer.
Figure 3:
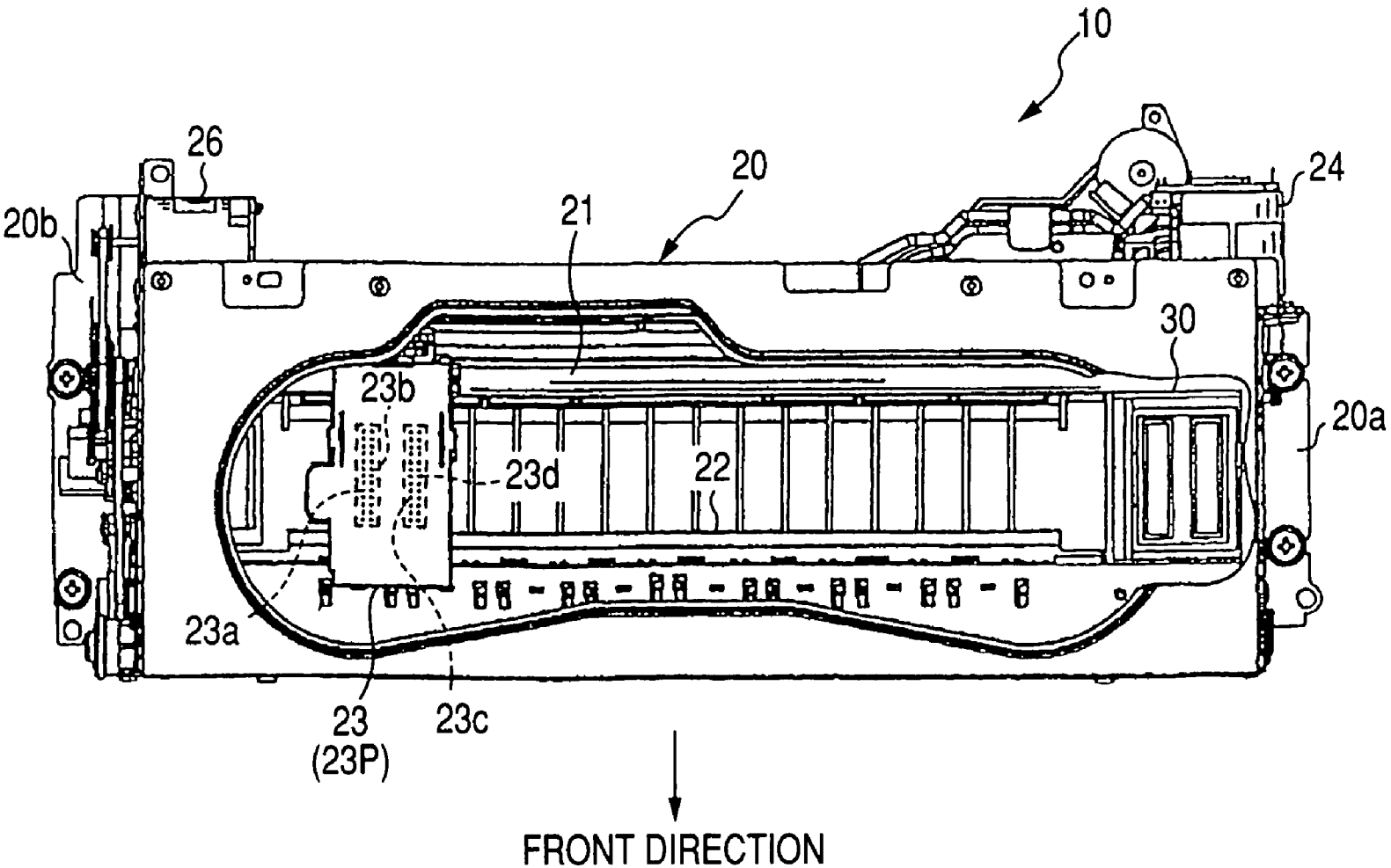
FIG. 3 is an explanatory view showing the constitution of the inkjet printer.

Next, a constitution of the inkjet printer 4 will be described in reference to FIG. 2 through FIG. 4.

The inkjet printer 4 includes a record mechanism portion 10 for recording an image on a sheet supplied from the sheet feeding apparatus 2 (for example, sheet of A4 size or letter size) by a recording head 23P, a maintenance mechanism portion 11 for executing a maintenance processing of the recording head 23P, an ink supply portion 12 for supplying ink from ink cartridges 40 through 43 to the recording mechanism portion 10, a pressurized air supply portion 13 for supplying pressurized air to the ink cartridges 40 through 43 and the like.

The recording mechanism portion 10 is contained in a recording unit frame 20 in a shape of a flat box including a reinforcement ceiling plate provided with an opening portion that permits access to a sheet. Both left and right end portions of a guide shaft 21 on a rear side and a guide rail 22 on a front side in the frame 20 are respectively fixed by a right side wall 20*a* and a left side wall 20*b*, a carriage 23 and the recording head 23P are guided and supported by the guide shaft 21 and the guide rail 22 movably in a left and right direction, and can be reciprocated in the left and right direction along the guide shaft 21 and the guide rail 22 by a carriage drive motor 24 via a timing belt. Further, the recording head 23P is fixedly connected to a front end side of the carriage 23, the carriage 23 is guided by the guide shaft 21 and the recording head 23P is guided by the guide rail 22.

Figure 4B:
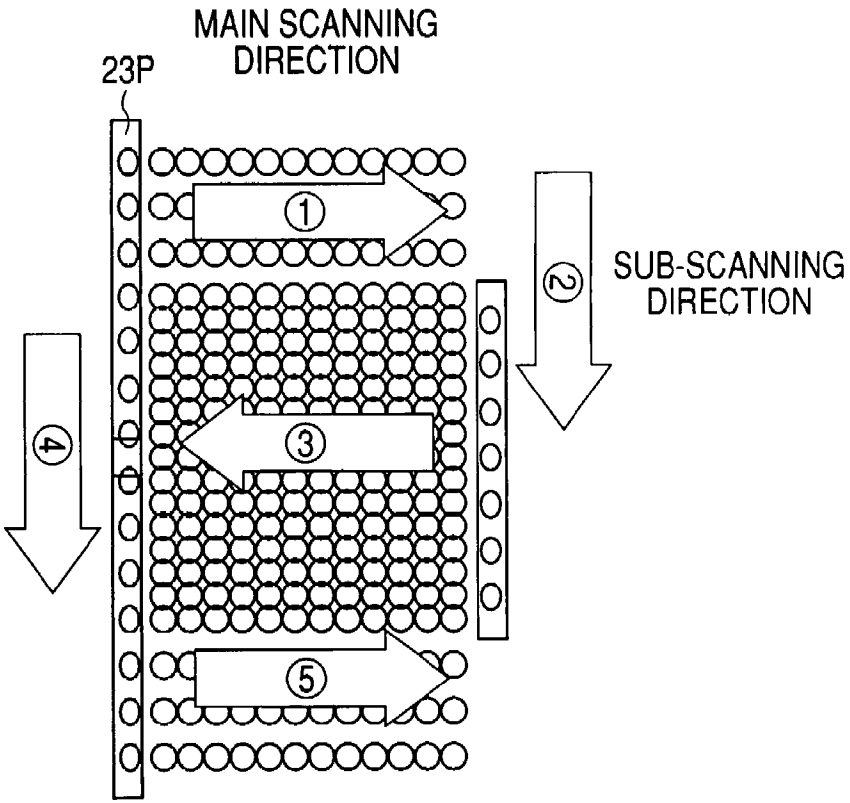
FIGS. 4A and 4B illustrate explanatory views showing operation of a recording head.
Figure 4A:
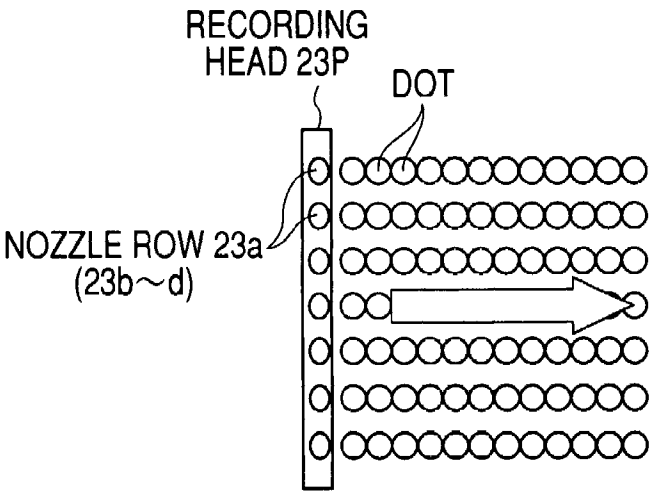

A lower face of the recording head 23P is provided with four rows of inkjet nozzle rows 23*a* through 23*d* corresponding to four colors of ink colors, and each nozzle row is provided with a number of inkjet nozzles. The nozzle row 23*a* for black and the nozzle row 23*b* for cyan are proximate to each other and the nozzle row 23*c* for magenta and the nozzle row 23*d* for yellow are proximate to each other. When the recording head 23P is scanned in the main scanning direction as shown by an arrow mark of FIG. 4A, the recording head 23P forms a dot on a sheet by ejecting an ink drop by being driven by a piezoelectric actuator. As shown in FIG. 4B, the recording head 23P forms an image on a sheet P by alternately repeating scanning in the main scanning direction (arrow marks 1, 3, 5) and scanning in the sub-scanning direction (arrow marks 2, 4) relative to the sheet. However, actually, the recording head 23P is not moved in the sub-scanning direction and the sheet is fed in the sub-scanning direction. Further, the recording head 23P may be a recording head of a heat generating element drive type.

A lower side of the guide shaft 21 is arranged with a main carry roller (not illustrated) to be respectively rotatably and axially supported, rotated in a predetermined rotational direction by a sheet feed motor 26 via a gear mechanism 27, carries a sheet fed from the sheet feeding apparatus 2 in a front sheet feeding direction while moving the sheet substantially horizontally on immediately lower side of the recording head 23P, and discharges the sheet onto the sheet discharging table 5.

The maintenance mechanism portion 11 is provided with a maintenance case 30 at a vicinity of a bottom portion of a right end portion in the record unit frame 20.

A front side of the ink supply portion 12 is arranged with the ink cartridge 40 of black, the ink cartridge 41 of cyan, the ink cartridge 42 of magenta, and the ink cartridge 43 of yellow successively from a left side in respectives of the ink cartridges 40 through 43. Insides of cartridge cases are expanded with flexible film members 40*a* through 43*a* substantially over entire regions thereof, and by the film members 40*a* through 43*a*, the cartridge cases are partitioned into ink containing chambers 40*b* through 43*b* on a lower side and air chambers 40*c* through 43*c* on an upper side. Respective inks are contained in the ink containing chambers 40*b* through 43*b*, and atmospheric air flows into the air chambers 40*c* through 43*c*. Black ink BI, cyan ink CI, magenta ink MI, and yellow ink YI are respectively contained in the ink containing chambers 40*b* through 43*b* of the ink cartridges 40 through 43.

Ink needles 44 are provided in a frontward projected shape respectively on depth sides of mounting portions for mounting the ink cartridges 40 through 43. Base end portions of the respective ink needles 44 are connected to the recording head 23P via corresponding exclusive ink supply tubes 45 through 48. The ink supply tubes 45, 46 are bundled to overlap in an up and down direction from middle portions thereof and also the ink supply tubes 47, 48 are bundled to overlap in the up and down direction from middle portions thereof.

The recording head 23P is arranged at a position higher than the ink cartridges 40 through 43 by a predetermined water head difference, and when the ink cartridges 40 through 43 are respectively mounted to the predetermined mounting portions, front end portions of the ink needles 44 insert through rear end portions of the film members 40*a* through 43*a* to reach the ink containing chambers 40*b* through 43*b*, and inks BI, CI, MI, YI of the ink containing chambers 40*b* through 43*b* are supplied to the recording head 23P by way of the ink supply tubes 45 through 48. In this way, nozzles 23*n* of the nozzles rows 23*a* through 23*d* of the recording head 23P are filled with inks BI, CI, MI, YI supplied by way of the ink supply tubes 45 through 48.

Next, an electric constitution of the inkjet printer 4 will be described in reference to a block diagram of FIG. 5 and FIG. 6 through FIG. 8.

The inkjet printer 4 is provided with CPU 51, RAM 58, ROM 61, which are connected to each other by buses, not illustrated. ROM 61 is stored with various data for functioning CPU 51. Further specifically, ROM 61 is provided with a record data generating program storing portion 62 stored with programs for generating record data, a logical carry amount calculating equation storing portion 63 stored with a calculating equation of a sheet carry amount (hereinafter, referred to as "logical carry amount") P per time necessary for recording an image on the record medium with a desired recording resolution d, and a carry amount corresponding data storing portion 64 stored with data for calculating quasi logical carry amounts P1, P2 for actually carrying a sheet when the logical carry amount P is not a natural number. Further, the carry amount corresponding data is data illustrated in FIG. 6 and is stored with a first quasi logical carry amount P1 and a second quasi logical carry amount P2 which are related to a range of the logical carry amount P. Specifically, the first quasi logical carry amount P1 is the largest natural number smaller than the logical carry amount P and the second quasi logical carry amount P2 is the smallest natural number larger than the logical carry amount P.

CPU 51 is provided with a carry control portion 52, a record control portion 53, a logical carry amount calculating portion 54 and a quasi logical carry amount calculating portion 55.

The carry control portion 52 carries a sheet by the logical carry amount P corresponding to the recording resolution d stored to a logical carry amount storing portion 59, or either of the quasi logical carry amounts P1, P2 stored to a quasi logical carry amount storing portion 60. Specifically, the carry control portion 52 calculates the logical carry amount P or the quasi carry amounts P1, P2 based on data stored to either of the logical carry amount storing portion 59 and the quasi logical carry amount storing portion 60 of RAM 58, and drives to rotate the sheet feed motor 26 via a motor driver 68 for carrying a sheet by the calculated logical carry amount P or the calculated quasi logical carry amounts P1, P2. Here, the logical carry amount storing portion 59 is stored with data illustrated in FIG. 7, that is, the logical carry amount P related to the recording resolution d. Further, the quasi logical carry amount storing portion 60 is stored with data illustrated in FIG. 8. Here, the data illustrated in FIG. 8 is stored with the first quasi logical carry amount P1 and the second quasi logical carry amount P2 in a related manner to the logical carry amount P of a nonnatural number in the data (refer to FIG. 7) stored to the logical carry amount storing portion 59.

Further, a rotating amount actually driven by the sheet feeding motor 26 is fed back by an encoder 67 attached to the sheet feeding motor 26.

The record control portion 53 functions as a record data generating portion by the record data generating program when image data (image data) is transmitted from PC (personal computer) connected to the multifunction machine 1 via an image input portion ≡and generates record data. The generated record data is transmitted to the recording head 23P via a head driver 69 and an image is formed on the sheet based on the record data.

The logical carry amount calculating portion 54 calculates the logical carry amount P for recording an image by a desired recording resolution d in a direction in parallel with the nozzle row aligned in the recording head 23P based on a logical carry amount calculating equation. Further, the calculating equation for calculating the logical carry amount P is a calculating equation calculated based on the recording resolution d and a number M of nozzles used for recording in the nozzle row of the recording head 23P and is represented by the following Equation $$\text{logical carry amount } P = \text{number of nozzle } M \times \text{unit carrying resolution of encoder } X / \text{recording resolution } d \quad (1)$$

Further, Equation (1) is derived as follows. First, a number of recording times (hereinafter, referred to as "Pass") necessary for recording a dot on a sheet by a desired recording resolution d by using the recording head 23P having a predetermined nozzle resolution V is represented by the following Equation (2).

$$\text{Pass} = \text{recording resolution } d / \text{nozzle resolution } V \quad (2)$$

Further, a total length of the recording head 23P is represented by the following Equation (3).

$$\begin{aligned} \text{recording head total length} &= \text{number of nozzle } M \times \text{nozzle interval} \\ &= \text{number of nozzle } M / \text{nozzle resolution } V \end{aligned} \quad (3)$$

Here, a logical carry length p [inch] corresponding to the logical carry amount P [pulse] is a value constituted by dividing the total length of the recording head 23P by Pass, and the logical carry length p [dpi] is a value constituted by converting the logical carry length p [inch] into a unit. The logical carry length p [inch] and the logical carry amount P [pulse] are represented as shown by Equation (4) shown below from Equation (2) and Equation (3), described above.

$$\text{logical carry length } p = \text{recording head total length} / \text{Pass} \quad (4)$$

$$\begin{aligned} \text{logical carry amount } P &= \text{logical carry length } p \times \text{unit carrying resolution of encoder } X \\ &= \text{number of nozzle } M / \text{nozzle resolution } V / (\text{recording resolution } d / \text{nozzle resolution } V) \times \text{unit carrying resolution of encoder } X \\ &= \text{number of nozzle } M \times \text{unit carrying resolution of encoder } X / \text{recording resolution } d \end{aligned}$$

In this way, Equation (1) is derived as the equation of representing the logical carry amount P [pulse].

Here, the unit carrying resolution X of the encoder 67 will simply be described. According to the embodiment, a rotary encoder is used for the encoder 67 and is disposed on a drive roller (not illustrated) connected with a sheet feeding motor. The rotary encoder 67 is formed with slits at intervals of 300[dpi] at a circular disk having a diameter of 6/π [inch]. At an upper portion of the rotary encoder 67, two pieces of optical sensors for detecting presence or absence of the slit are provided at positions shifted from each other to an extend that corresponds to 1,200[dpi]. By detecting the slits formed at the interval of 300 [dpi] by two pieces of the optical sensors, there is achieved a resolution of 1,200[dpi] as a detecting capability which is four times of the slit interval. Here, the unit carrying resolution X of the encoder 67 is calculated by "X=circumference×optical sensor resolution". Therefore, when the slits at intervals of 300[dpi] formed on the circumference of 6/π and two pieces of the optical sensors achieving the resolution of 1,200[dpi] are used, $X=6/\pi\times\pi\times1{,}200=7{,}200$ [dpi] which becomes the resolution of the encoder 67 according to the embodiment.

The quasi logical carry amount calculating portion 55 calculates the carry amount for actually carrying the sheet (first quasi logical carry amount P1 and second quasi logical carry amount P2) when the logical carry amount P is not a natural number. That is, a rotating amount per time of the sheet feeding motor 26 becomes the unit pulse (unit carrying resolution X) of the encoder 67 having a predetermined resolution (unit carrying resolution of encoder) multiplied by a natural number. Therefore, when the logical carry amount P is not a natural number, the sheet cannot be carried by an amount of the logical carry amount P which is not a natural number. In this case, the quasi logical carry amount calculating portion 55 calculates the carry amounts P1, P2 for actually carrying the sheet although difference amounts thereof from the logical carry amount P are produced.

Next, processing executed by CPU 51 of the inkjet printer 4 will be described in reference to FIG. 9 through FIG. 14.

Figure 9:
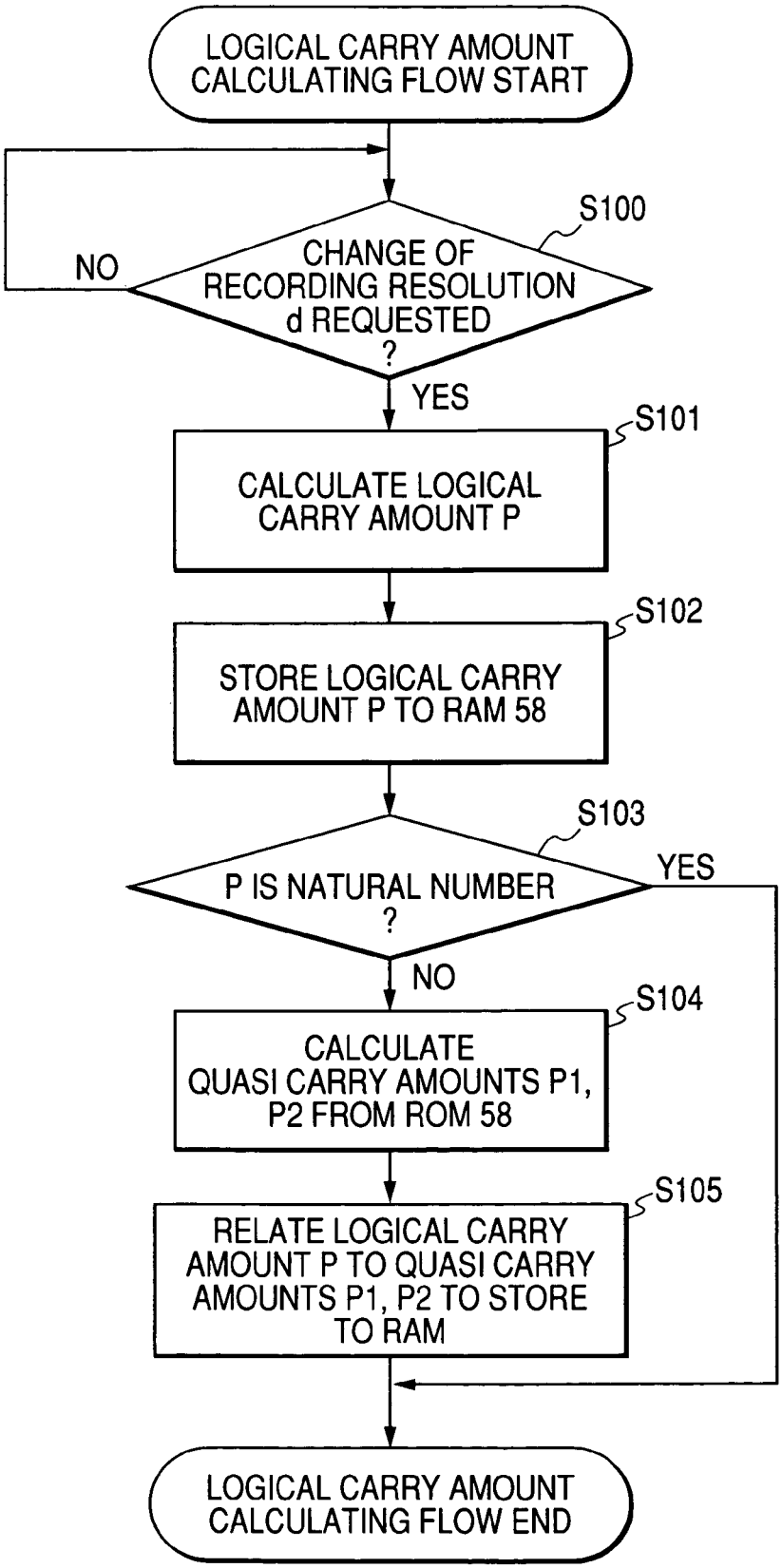
FIG. 9 is a flowchart showing a processing of calculating a logical carry amount.

A flow shown in FIG. 9 is a flow for calculating the logical carry amount P. Calculation of the logical carry amount P is executed by inputting a change of the recording resolution d from a keyboard 66. At step 100, when a change of the recording resolution d is inputted, the operation proceeds to step 101, and the logical carry amount calculating portion 54 calculates the logical carry amount P by using Equation (1) stored at the logical carry amount calculating equation storing portion. At this occasion, when the change of the recording resolution d is not inputted, the change is set to a default value (for example, 1.200 [dpi]). Further, at step 102, the calculated logical carry amount P is stored to the logical carry amount storing portion 59 of RAM 58. Incidentally, in this embodiment, the number of nozzle M is 13 pieces.

The operation proceeds to step 103, and it is determined whether the logical carry amount P calculated at step 101 is a natural number. Here, when the logical carry amount P is a natural number, the logical carry amount calculating flow is finished. On the other hand, when the calculated logical carry amount P is a nonnatural number, the operation proceeds to step 104 and calculates the first quasi logical carry amount P1 and the second quasi logical carry amount P2 based on data (refer to FIG. 6) stored to the carry amount corresponding data storing portion 64. Further, at step 105, the calculated first quasi logical carry amount P1 and the calculated second quasi logical amount P2 are stored to the quasi logical carry amount storing portion of RAM 58 in a related manner to the logical carry amount P (refer to FIG. 8) and thereafter, the logical carry amount calculating flow is finished.

Figure 5:
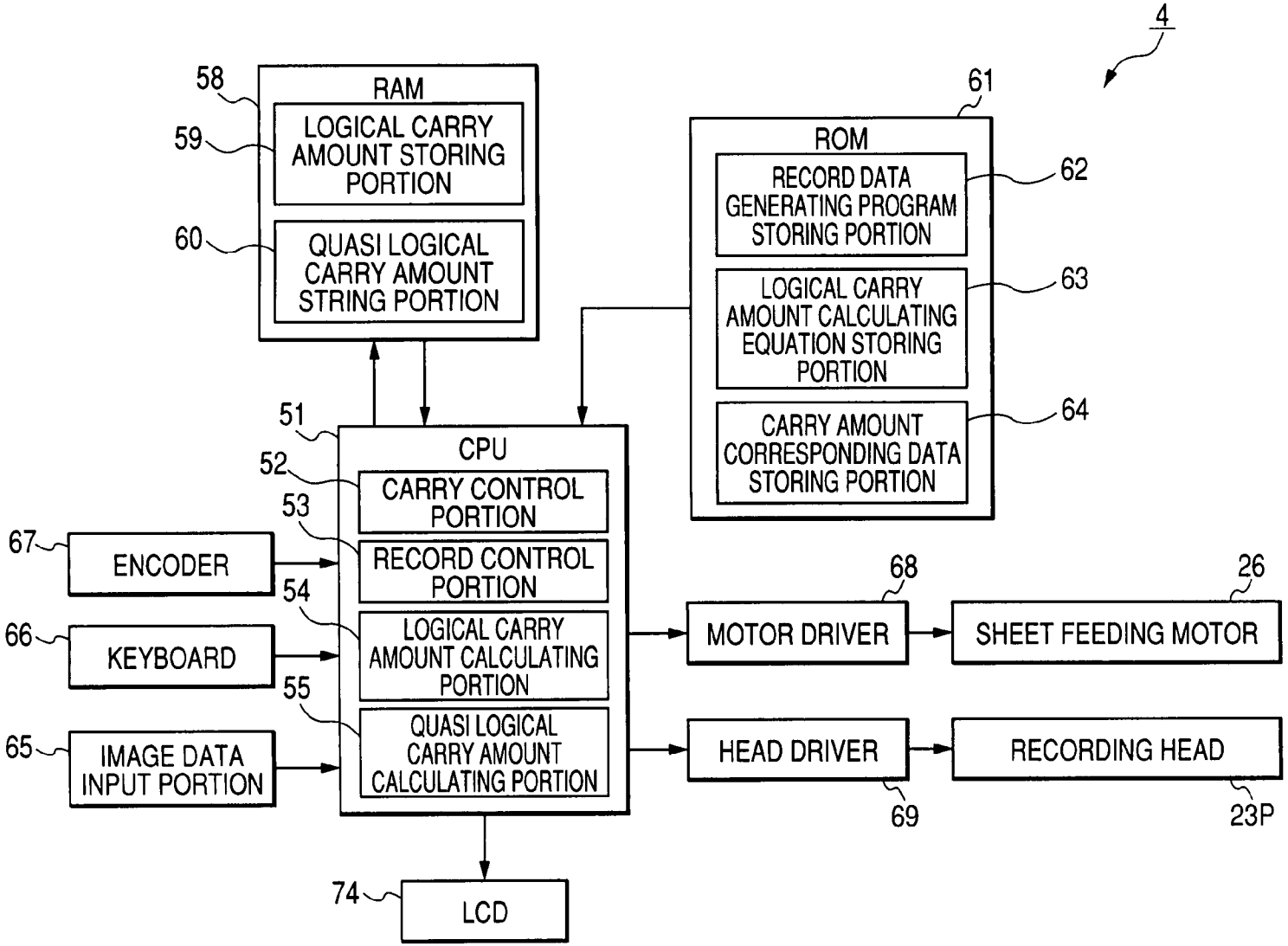
FIG. 5 is a block diagram showing an electric constitution of the inkjet printer.
Figure 10:
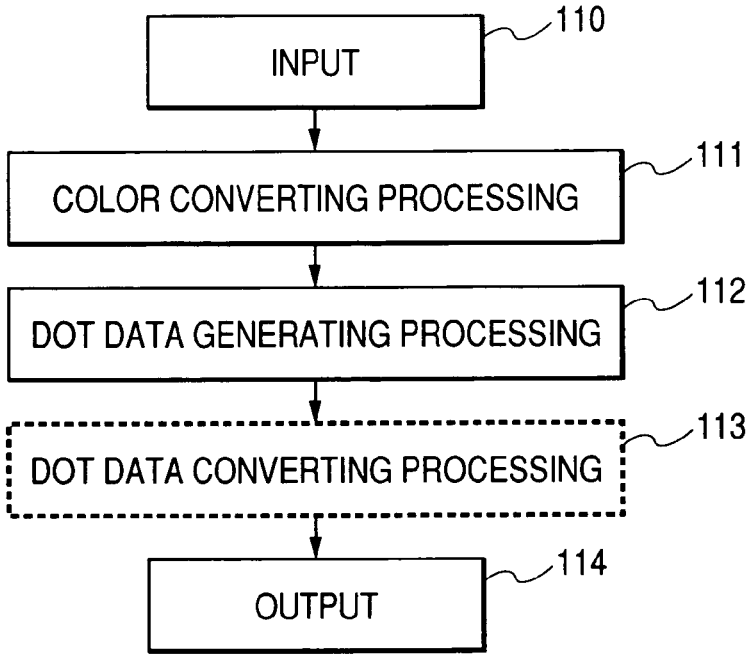
FIG. 10 is a flowchart showing a processing of generating print data.

At step 110 of FIG. 10, image data is inputted to CPU 51 via the image data input portion 65 (refer to FIG. 5). The image data is image data of CMYK 4 colors system. Further, the image data may be image data of RGB system. Further, image data is data of 256 gray scales of 0 through 255.

At step 111, the image data is converted by a color converting processing. Specifically, conversion is executed by LUT (Look-Up Table) conversion.

At step 112, dot data of 4 gray scales (4 gray scales of large dot, middle dot, small dot, not recorded) is generated from the image data of 256 gray scales by a dot data generating processing. In the dot data generating processing, a half tone processing of a dithering processing, an error diffusing processing or the like is used.

At step 113, the dot data is converted by a dot converting data processing. The converted dot data is made to constitute a print data. Further, the dot data converting processing will be described later in details.

At step 114, the converted dot data is transmitted to the recording head 23P as print data. The recording head 23P forms an image on a sheet by using the print data.

Figure 11:
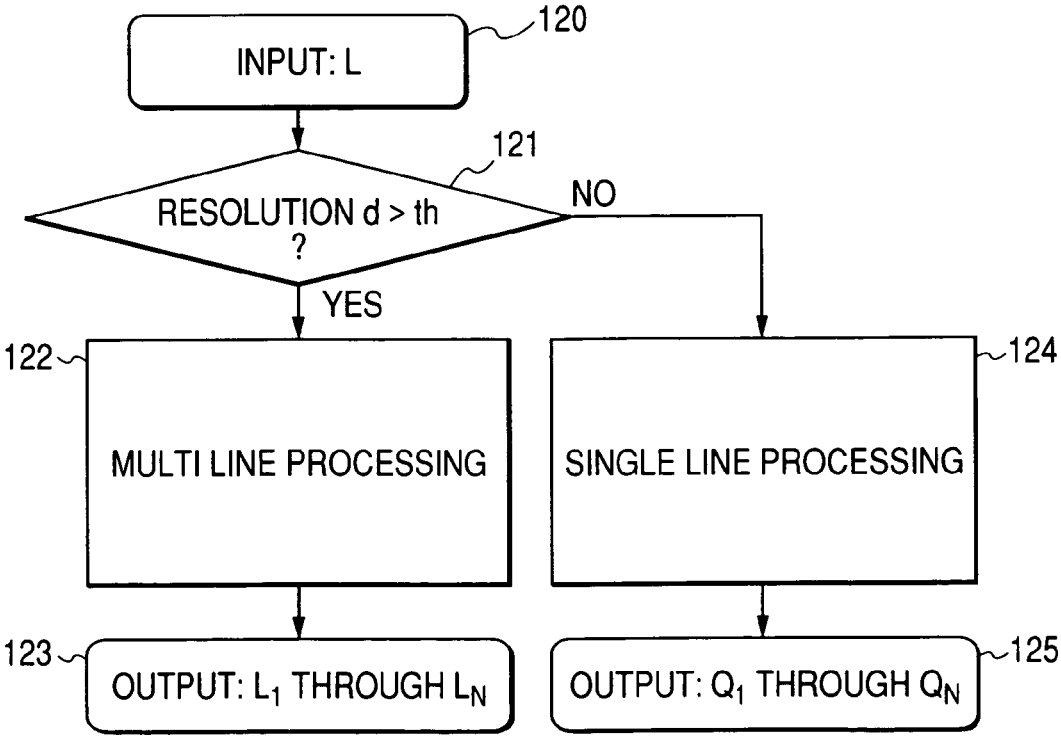
FIG. 11 is a flowchart showing a dot data converting processing.

Next, the dot data converting processing at step 113 will be described in reference to a flowchart of FIG. 11.

At step 120, one line data L is read from dot data. The line data L is data corresponding to one line along the main scanning direction.

At step 121, it is determined whether the recording resolution d in the main scanning direction of the read line data L is equal to or larger than a threshold th. In the case of YES, the operation proceeds to step 122 and in the case of NO, the operation proceeds to step 124. Here, the threshold th is 508[dpi].

At step 122, a multi line processing is executed for the line data L. Here, the multi line processing refers to a processing of dividing 1 piece of the line data L into 5 pieces of divided line data L1, L2, L3, L4, L5 based thereon.

The multi line processing is executed by multiplying the line data L by a mask M shown in FIG. 18. That is, by multiplying the line data L by a mask M1, the divided line data L1 is generated. Similarly as follows, the divided line data L2 is generated by multiplying the line data L by a mask M2, the divided line data L3 is generated by multiplying the line data L by a mask M3, the divided line data L4 is generated by multiplying the line data L by a mask M4, and the divided line data L5 is generated by multiplying the line data L by a mask M5. Further, the masks M1 through M5 are utilized such that $L1(i)=M1(i\%j)\times L(i)$, $L2(i)=M2(i\%j)\times L(i)$, $L3(i)=M3(i\%j)\times L(i)$, $L4(i)=M4(i\%j)\times L(i)$, $L5(i)=M5(i\%j)\times L(i)$ and are repeatedly used in accordance with a data length of the line data L. Here, notation i designates a dot number in the main scanning direction, notation j designates data lengths of the masks M1 through M5, and notation % designates a function of rounding up a residue of (i/j).

Figure 19:
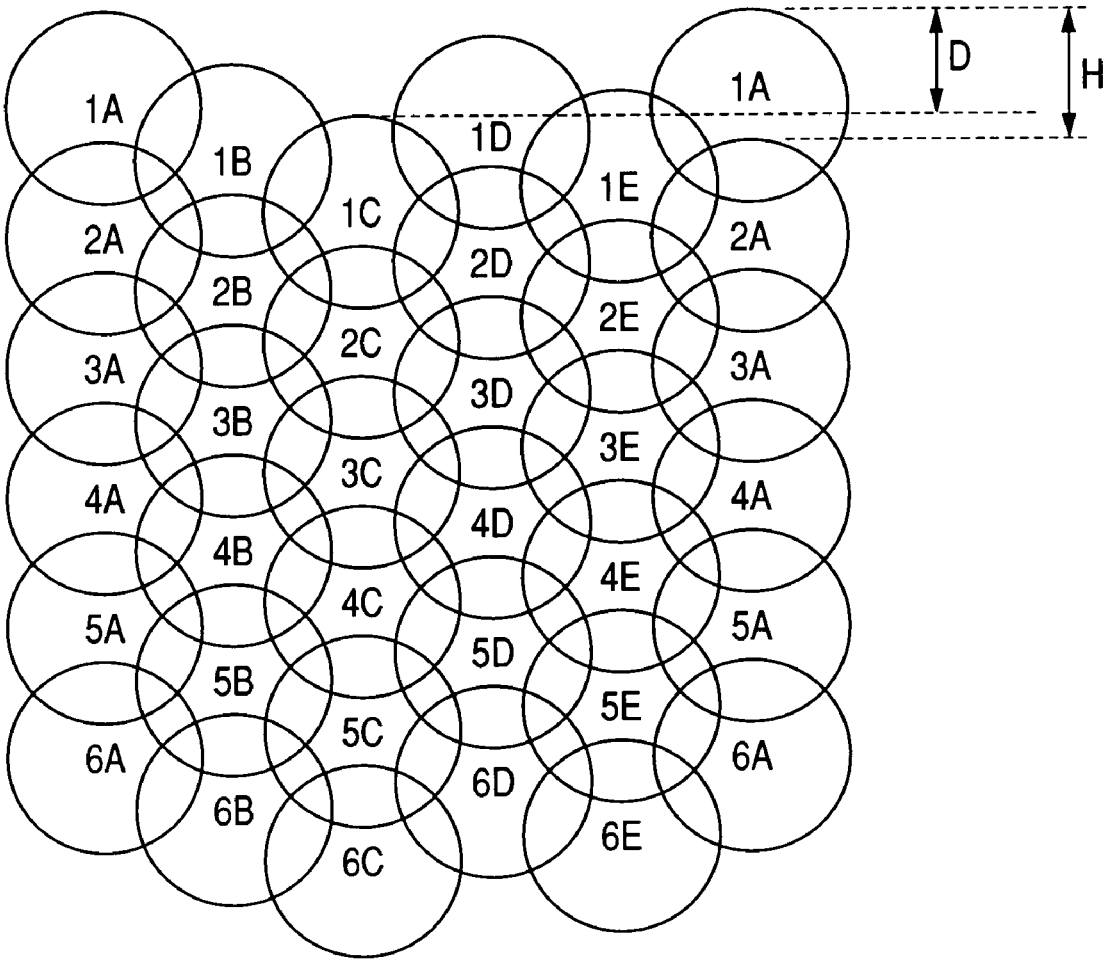
FIG. 19 is an explanatory view showing a state of aligning a dot on a sheet.

Further, as shown in FIG. 19, a line of 1A is formed based on the divided line data L1 divided from 1 piece of the line data L, a line of 1B is formed based on the divided line date L2, a line of 1C is formed based on the divided line data L3, a line of 1D is formed based on the divided line data L4, and a line of 1E is formed based on the divided line data L5. The same goes with the line data L thereafter. Further, a pitch of contiguous lines of the respective divided line data L1, L2, L3, L4, L5 becomes H/5 and therefore, a length of an image in the sub-scanning direction is the same as that in a case of not dividing the line data L.

The masks M1 through M5 are constituted to constitute the line data L when the respective divided line data L1 through L5 are added up. That is, the masks M1 through M5 are constituted such that in divided line data Lk (k is 1 through 5), when an i-th dot in the main scanning direction is designated by notation Lk(i), in the line data L, an i-th dot in the main scanning direction is designated by notation L(i), the masks M1 through M5 are constituted to constitute $L(i)=\Sigma Lk(i)$. As the masks M1 through M5, as shown in FIG. 18, an element of a matrix may be either of 1 or 0 and a total of each row or each column of the matrix may be 1.

At step 123, the divided line data L1 through L5 is outputted to the recording head 23P as print data.

On the other hand, when it is determined as NO at step 121, the operation proceeds to step 124. At step 124, 1 piece of the line data L is subjected to a single line processing for outputting 1 piece of the line data L as it is as print data (that is, substantially not converted). At step 125, print data Q (substantially equivalent to the line data L) is outputted to the recording head 23P.

Figure 12:
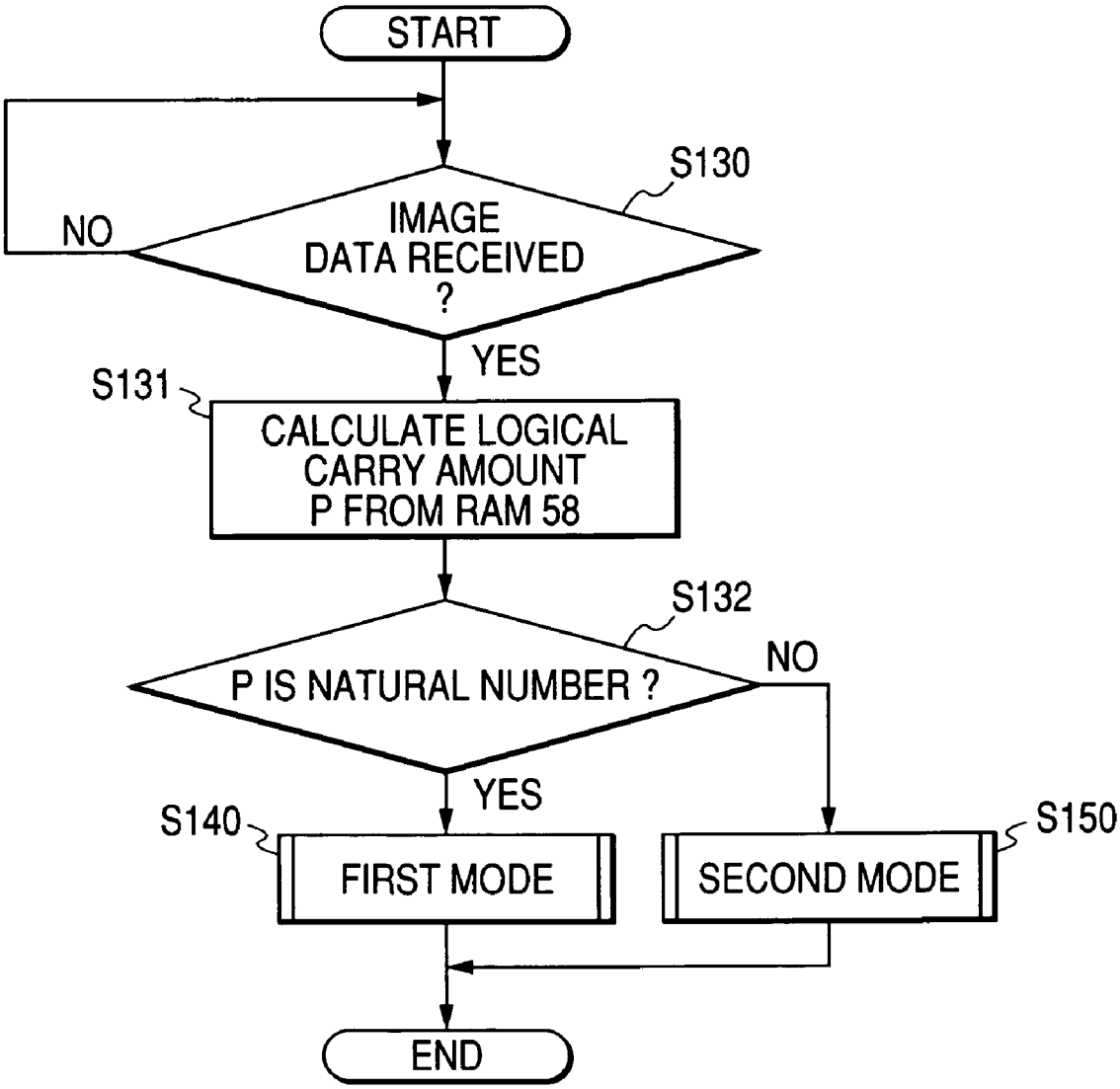
FIG. 12 is a flowchart showing a processing of driving a sheet feeding motor and a recording head.

Next, FIG. 12 shows a control flow for controlling to record an image on a sheet by the inkjet printer 4 according to the embodiment, that is, for driving the sheet feeding motor 26 and the recording head 23P.

Incidentally, in this embodiment, a procedure of a processing executed by CPU 51 is indicated by "step" and indicated as "S" in the drawings.

At step 130, the inkjet printer 4 is at standby for inputting image data to CPU 51 via the image data input portion 65 (refer to FIG. 5). When image data is received, the operation proceeds to step 131, the record control portion reads the logical carry amount P related to the set recording resolution d based on data (refer to FIG. 7) stored to the logical carry amount storing portion 59 of RAM 58. The operation proceeds to step 132, and the record control portion confirms whether the logical carry amount P calculated at step 131 is a natural number. When the logical carry amount P is a natural number, the operation proceeds to step 140, and the image is recorded on a sheet by a first mode. On the other hand, when the logical carry amount P is a nonnatural number, the operation proceeds to step 150 and the image is recorded on a sheet by a second mode.

Figure 13:
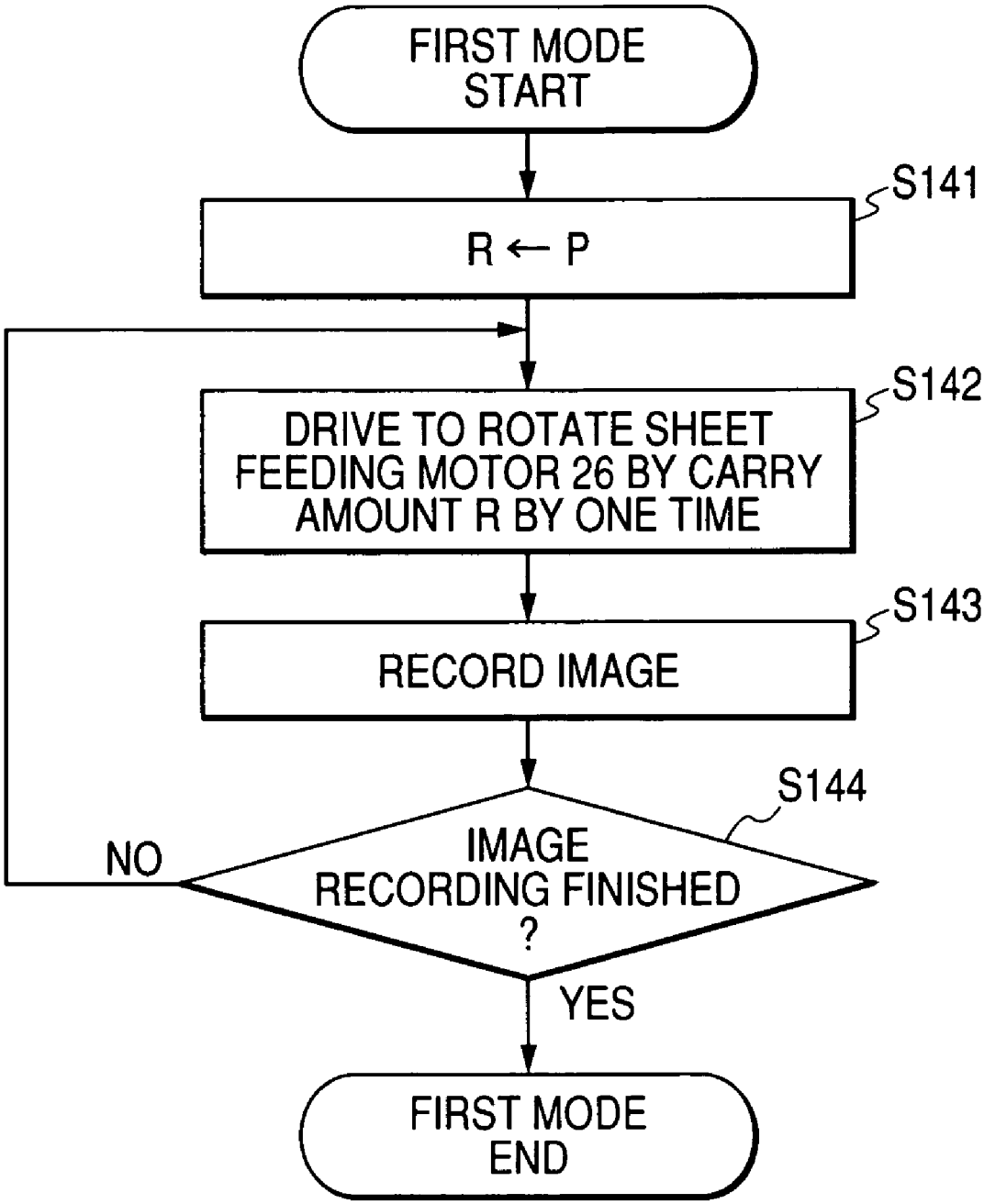
FIG. 13 is a flowchart showing a processing in a first mode.

A control flow of the first mode will be will be described in reference to FIG. 13. Incidentally, a sheet is carried by controlling the sheet feeding motor 26 by the carry control portion 52 based on a set carry amount R. At step 141, the logical carry amount P is set to the set carry amount R. Thereafter, the operation proceeds to step 142, the sheet feeding motor 26 is driven to rotate by one time based on the set carry amount R. Here, "one time" is a value of the unit carry amount multiplied by a natural number. Further, when the sheet feeding motor 26 is driven to rotate by one time, the sheet is fed by the set carry amount R. Further, when the sheet is fed by one time, the operation proceeds to step 143, and the record control portion 53 records an image on the sheet. Here, when all of the image is not finished to record, the operation returns to step 142 and when all the image has been finished to record, the image by the first mode is finished to record.

Figure 14:
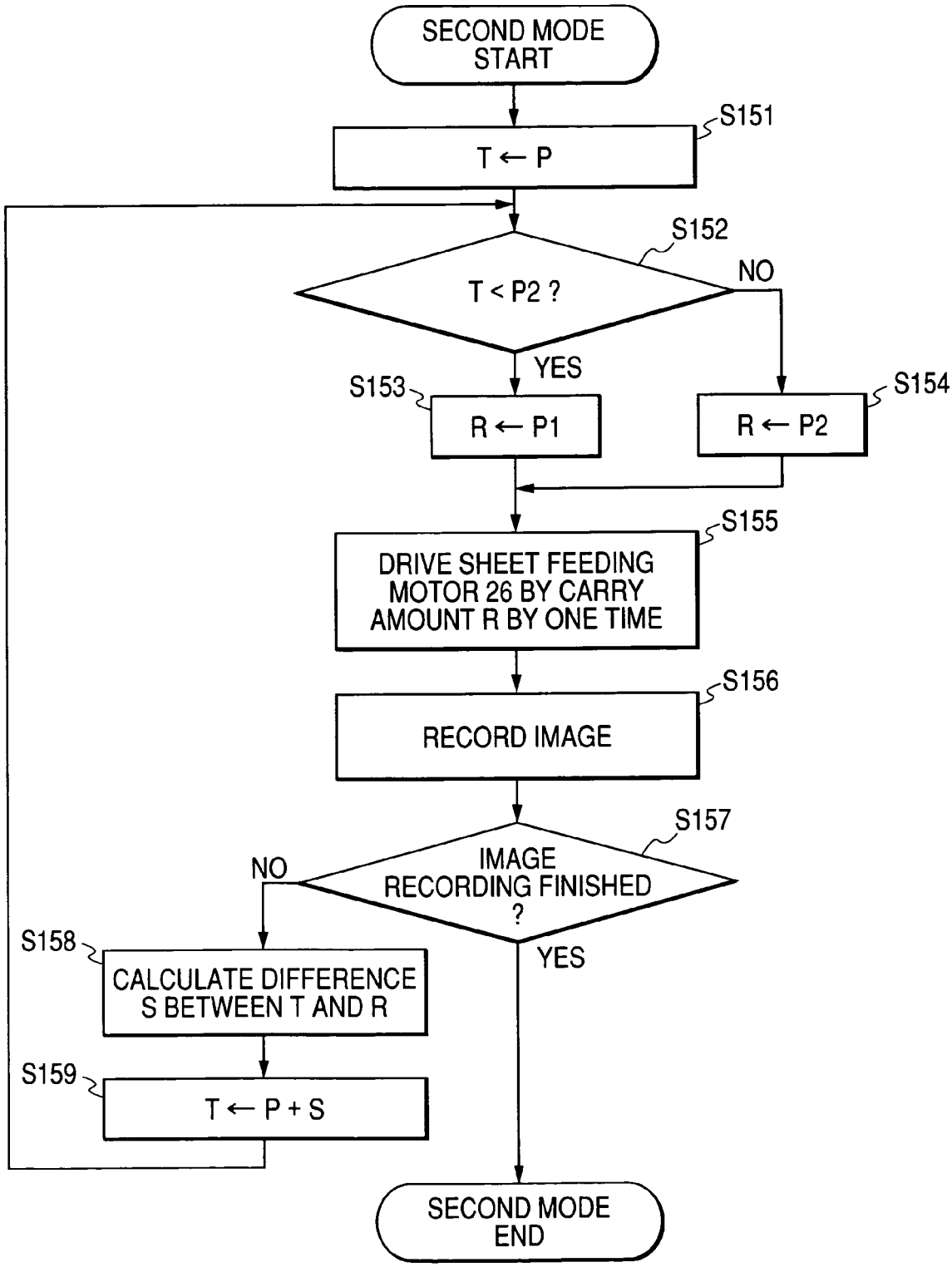
FIG. 14 is a flowchart showing a processing in a second mode.
Figure 15:
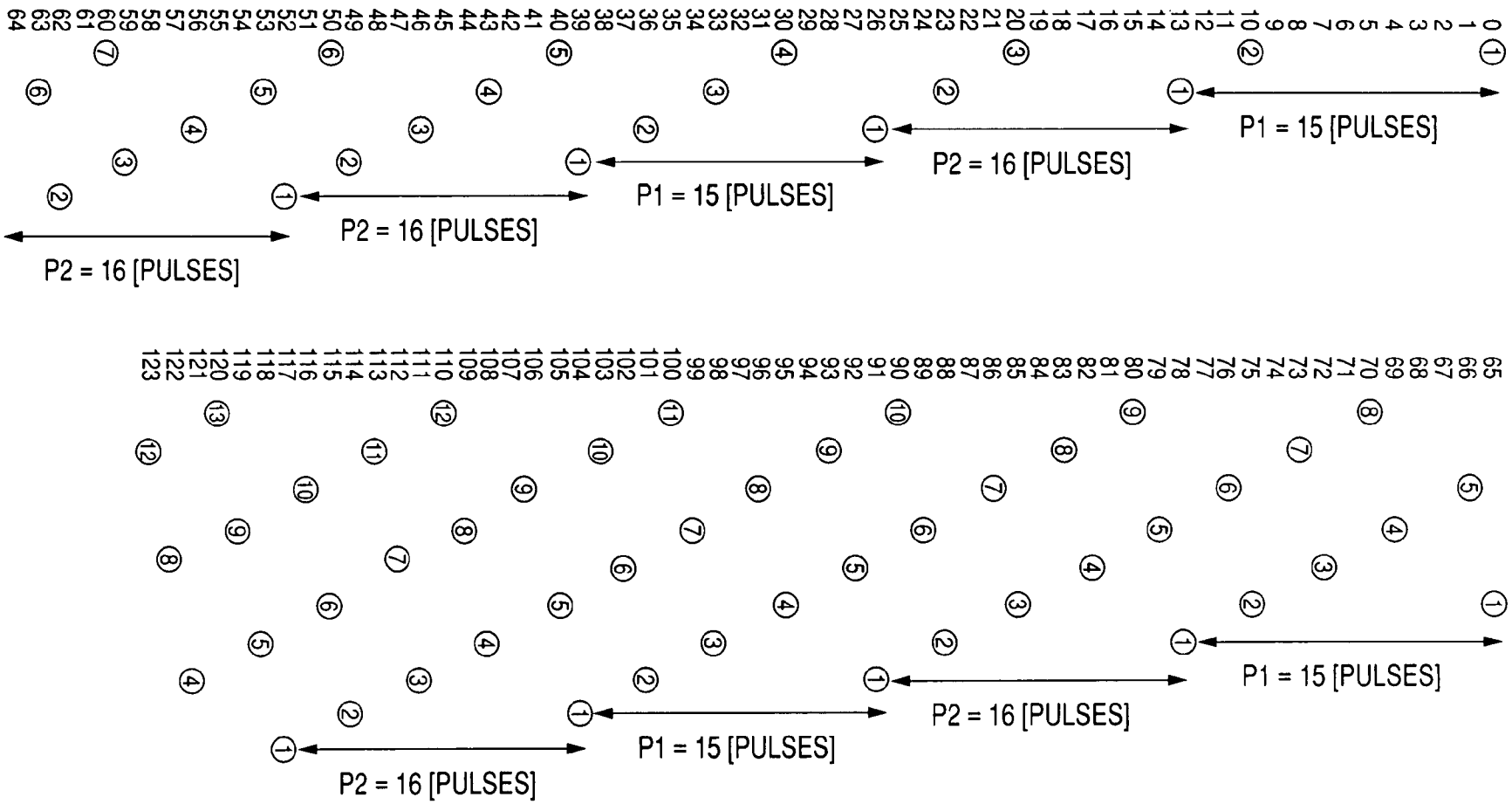
FIG. 15 is a view showing a mode of recording dots on a sheet.

A control flow in the second mode will be described in reference to FIG. 14 through FIG. 16. Here, FIG. 14 is a diagram of a control flow, FIG. 15 is a view representing a mode of recording a dot image on a sheet, and FIG. 16 shows data of a table showing a difference S between the logical carry amount P and a carry amount (quasi logical carry amounts P1, P2) by which the sheet is actually carried for a carry number of times N. In this embodiment, the number of nozzle N is 13 pieces, the nozzle resolution V is V=600[dpi], the recording resolution d is d=6,000[dpi], and the unit carrying resolution X of the encoder is 7,200[dpi]. Therefore, the logical carry amount P becomes P=15.6[pulses]. When P is 15.6, the quasi logical carry amounts P1, P2 respectively become P1=15, P2=16 by data (refer to FIG. 6) stored to the carry amount corresponding data storing portion 64. Further, similar to the first mode, a sheet is carried by controlling the sheet feeding motor 26 by the carry control portion 52 based on the set carry amount R.

In the second mode, the logical carry amount P is a non-natural number, and therefore, the sheet is carried by either of the first quasi carrying amount P1 and the second quasi carry amount P2. Therefore, in carrying the sheet at a first time, there is produced the difference S between a carry amount by which the sheet is to be carried (the logical carry amount P in carrying the sheet at the first time) T and the carry amount by which the sheet is actually carried (either of the first quasi carry amount P1 and the second quasi carry amount P2). Therefore, in carrying the sheet at a second time after carrying the sheet at the first time, it is necessary to carry the sheet by an amount of adding the difference S (S=0.6) produced in carrying the sheet at the first time to the logical carry amount P. That is, the carry amount T by which the sheet is to be carried by carrying the sheet at an N-th time (N is an arbitrary natural number) becomes a sum of the difference S produced in carrying the sheet until an (N−1)th time and the logical carry amount P. Here, the difference S is a difference between the carry amount T by which the sheet is to be carried and the carry amount (set carry amount) R by which the sheet is actually carried.

First, at step 151, the logical carry amount P (P=15.6) is set as the carry amount T by which the sheet is to be carried. The operation proceeds to step 152, the carry control portion 52 determines whether the carry amount T by which the sheet is to be carried is smaller than the second quasi logical carry amount P2 (P2=16). Here, when the carry amount T (T=P) by which the sheet is to be carried is smaller than the second quasi logical carry amount P2 (P2=16), the operation proceeds to step 153 and the first quasi logical carry amount P1 (P1=15) is set as the set carry amount R. On the other hand, when the carry amount T by which the sheet is to be carried is equal to or larger than the second quasi logical carry amount P2, the operation proceeds to step 154, and the second quasi logical carry amount P2 is set as the set carry amount R. Therefore, in carrying the sheet at a first time, the second quasi logical carry amount P1 (P1=15) is set as the set carry amount R.

When the set carry amount R is set, the operation proceeds to step 155, and the carry control portion 52 drives to rotate the sheet feeding motor 26 by one time in order to carry the sheet by the set carry amount R. Thereby, the sheet is carried by R. Further, when the sheet is carried by R, the operation proceeds to step 156, and the record control portion 53 records an image on the sheet by controlling the recording head 23P via the head driver 69. The operation proceeds to step 157, and when all of the image has been finished to record, the image is finished to record by the second mode and when all of the image has not been finished to record, the operation proceeds to step 158.

At step 158, the carry control portion 52 calculates the difference S between the carry amount T by which the sheet is to be carried and the mount (that is, the set carry amount) R by which the sheet is actually carried. According to the embodiment, for example, in carrying the sheet at the first time, the carry amount T by which the sheet is carried is set as the logical carry amount P, the first quasi logical carry amount P1 is set as the set carry amount R, respectively, and therefore, the difference S between the logical carry amount P and the set carry amount R becomes S=0.6[pulse] (refer to FIG. 16).

After calculating the difference S between the carry amount T by which the sheet is to be carried and the set carry amount R, the operation proceeds to step 159, and the carry control portion 52 calculates the carry amount T by which the sheet is to be carried in carrying the sheet at a succeeding time. Here, in carrying the sheet at the succeeding time, the carry amount T by which the sheet is to be carried is a sum of the logical carry amount P and the difference S calculated at step 158. For example, the difference S calculated at step 158 in carrying the sheet at a first time is S=0.6[pulse] and therefore, the carry amount T by which the sheet is to be carried in carrying the sheet at a second time is T=16.2[pulse] (refer to FIG. 16).

After calculating the carry amount T by which the sheet is to be carried in carrying the sheet at the succeeding time at step 159, the operation returns to step 152. Here, for example, in carrying the sheet at the second time, the carry amount T (T=16.2[pulse]) by which the sheet is to be carried is larger than the second quasi logical carry amount P2 (P2=16 [pulses]) and therefore, the second quasi logical carry amount P2 is set as the set carry amount R. In the following, the processing is executed by the above-described flow and at a time point of finishing to carry the sheet at the second time, the difference S (S=0.2[pulse]) calculated by the logical carry amount P and step 158 becomes smaller than the difference S (S=0.6[pulse]) at a time point of finishing to carry the sheet at the first time (refer to FIG. 16).

By repeating such series of processing, in the case of carrying the sheet by N times, a difference between a value of the logical carry amount P multiplied by N and an accumulated value of the carry amount (set carry amount) R by which the sheet is actually carried can be prevented from exceeding 1 [pulse]. At a time point of finishing to record the image by the second mode, a difference between an accumulated value of the carry amount R by which the sheet is actually carried and an accumulated value of the logical carry amount P can be reduced.

Further, in FIG. 15, consecutive numerals from 0 to 123 correspond to dots for the desired recording resolution d. That is, a distance between respective numerals becomes a value similar to the recording resolution d. Further, circled numerals from 1 to 13 correspond to respective nozzles for recording dots on the sheet. That is, since the number of nozzle M is 13 pieces according to the embodiment and therefore, a distance between the respective circled numerals becomes a value corresponding to the nozzle resolution V. Here, in recording dots to the sheet by the recording head 23P, for example, in the case of a first nozzle of a circled numeral 1, the nozzle records a dot at a position of 0 after carrying the sheet at the first time and records a dot at a position of 13 after carrying the sheet at the second time. An arrow mark illustrated in FIG. 15 indicates a distance between a position of recording a dot after carrying the sheet at an N-th time and a position of recording a dot after carrying the sheet at an (N+1)-th time. Further, the arrow mark indicates a carry amount of carrying the sheet when the sheet feeding motor 26 is driven to rotate by one time and corresponds to the carry amount shown in FIG. 16.

Figure 20:
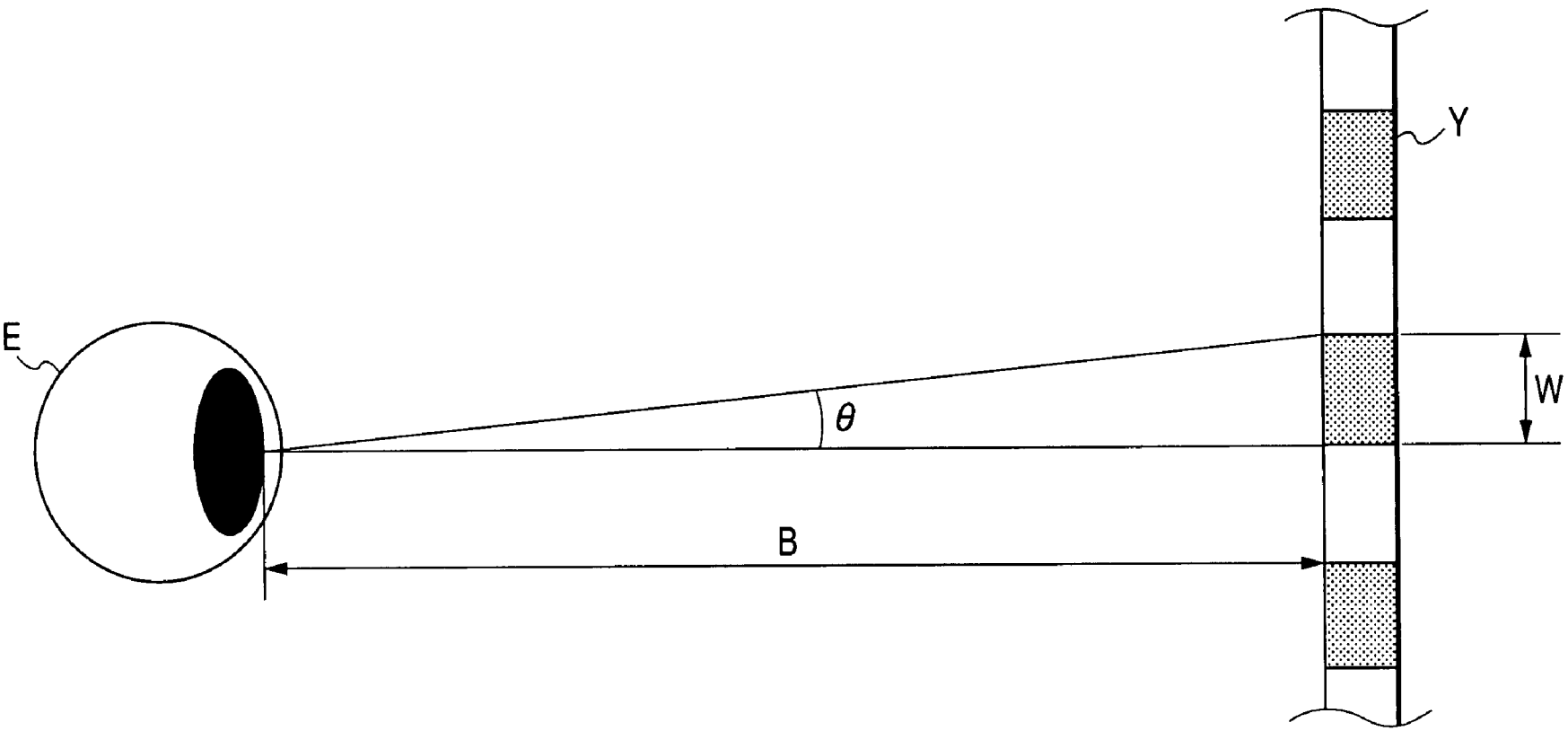
FIG. 20 is an explanatory view of a visibility limit resolution.

In this way, in the case of the inkjet printer 4 having the second mode, a dot image can be recorded on a sheet with the recording resolution d which is not a divisor of the unit carrying resolution X of the encoder 67. Particularly, when the unit carrying resolution X of the encoder 67 is equal to or larger than a visibility limit resolution W, it is preferable that even when the difference S between the carry amount T by which the sheet is to be carried and the set carry amount R is produced, the difference S is not optically recognizable by the eye of the human being. The visibility limit resolution W will be explained in reference to FIG. 20 as follows.

The "visibility limit resolution" refers to a resolution of a limit recognizable by the human being as a resolution on a sheet. The "visibility limit resolution" is determined by a distance (observation distance) B between the eye E of the human being and a sheet Y illustrated in FIG. 20 and is represented by Equation (5) shown below.

$$\text{visibility limit resolution } W=\alpha/\{\tan(\text{visibility limit field angle } \theta\times\pi/180)\times\text{observation distance } B\} \quad (5)$$

where a coefficient $\alpha$ is a coefficient for converting a unit from millimeter to inch, and notation $\theta$ designates the visibility limit field angle.

According to "Fine image and hard copy" (edited by Corp. Japan Photography Society, Japan Image Society issued by Corona Corp.), the visibility limit field angle $\theta$ is determined to be $\theta$=2 through 10[seconds]. Further, the observation distance B depends on a size of a sheet. For example, it is preferable that in the case of a sheet viewed from a remote distance such as a poster or the like, the observation distance is set to B=5,000 [mm] and in the case of A4 size, the observation distance is set to B=250 [mm].

According to the inkjet printer 4 of the embodiment, an image is recorded frequently by A4 size and therefore, the observation distance is set to B=250 [mm]. Further, when the visibility limit field angle is set to $\theta$=10[seconds], the visibility limit resolution W becomes nearly equal to 2,001[dpi]. However, in order to achieve a higher image quality, it is preferable to set the visibility limit field angle as $\theta$=4[seconds], and the visibility limit resolution W in this case becomes nearly equal to 5,002. Further, in the case of a limit value of the visibility field angle $\theta$=2[seconds], W becomes nearly equal to 10,000[dpi].

Therefore, the unit carrying resolution X of the encoder 67 used in the inkjet printer 4 is at least equal to or larger than 2,000[dpi], further preferably, equal to or larger than 5,000 [dpi]. Further, when the unit carrying resolution X of the encoder 67 is equal to or larger than 10,000[dpi], it can be regarded that an error of an image is not recognizable for most persons.

Figure 21:
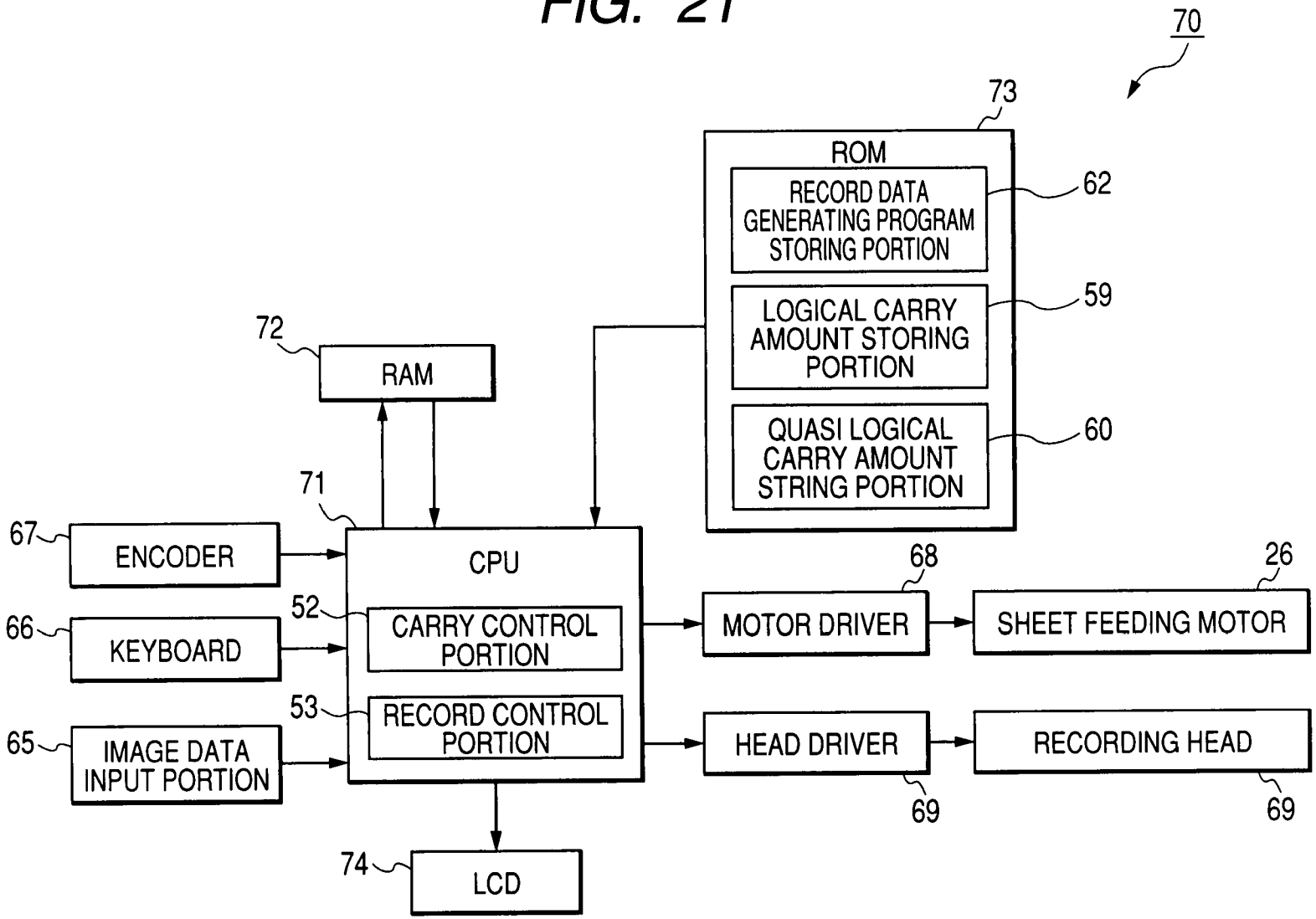
FIG. 21 is a modified example of a block diagram showing an electric constitution of an inkjet printer.

Incidentally, the first embodiment can be modified as follows. For example, the inkjet printer may be constructed by a constitution of a block diagram illustrated in FIG. 21 in place of the block diagram illustrated in FIG. 5. Here, an inkjet printer 70 having a constitution illustrated in FIG. 21 will be described. Further, elements having constitutions similar to those of the inkjet printer 4 having the constitution illustrated in FIG. 5 are attached with the same notations.

The inkjet printer 70 is provided with CPU 71, RAM 72 and ROM 73. Although CPU 71 is provided with the carry control portion 52 and the record control portion 53, CPU 71 is not provided with the logical carry amount calculating portion 54. Although the logical carry amount storing portion 59 and the quasi logical carry amount storing portion 60 are provided not at RAM 73 but at ROM 61, ROM 61 is not provided with the logical carry amount calculating equation storing portion 63 and the carry amount corresponding data storing portion 64. That is, the inkjet printer 70 having the constitution of the block diagram illustrated in FIG. 21 does not calculate the logical carry amount P and the quasi logical carry amounts P1, P2 but is stored with the logical carry amount P and the quasi carry amounts P1, P2 in a related manner to the recording resolution d. In this case, the recording resolution d is changed by selecting any one of the recording resolutions d (refer to FIG. 7) previously stored to the logical carry amount storing portion 59. Specifically, there are displayed the recording resolutions d corresponding to multiples of the nozzle resolution V stored to the logical carry amount storing portion 69 on LCD 74. Further, when a desired one of the recording resolution d is selected by the keyboard 66 and the selected recording resolution d is determined (by depressing a determination button provided at the keyboard 66 or the like), the determined resolution d is inputted to CPU 51. The recording resolution d is set in this way. Further, when the recording resolution d is not changed, the value is set to a default value (for example, 1,200[dpi]). In this way, although according to the inkjet printer 70 having the constitution illustrated in FIG. 21, an arbitrary recording resolution cannot be set, CPU 51 does not need to calculate the logical carry amount P and the quasi logical amounts P1, P2 and therefore, a processing burden is alleviated.

Next, an electric constitution of the multifunction machine according to the second embodiment will be described in reference to FIG. 22. Further, constitutions having functions the same as those of the first embodiment are attached with notations the same as notations attached to the first embodiment.

Figure 22:
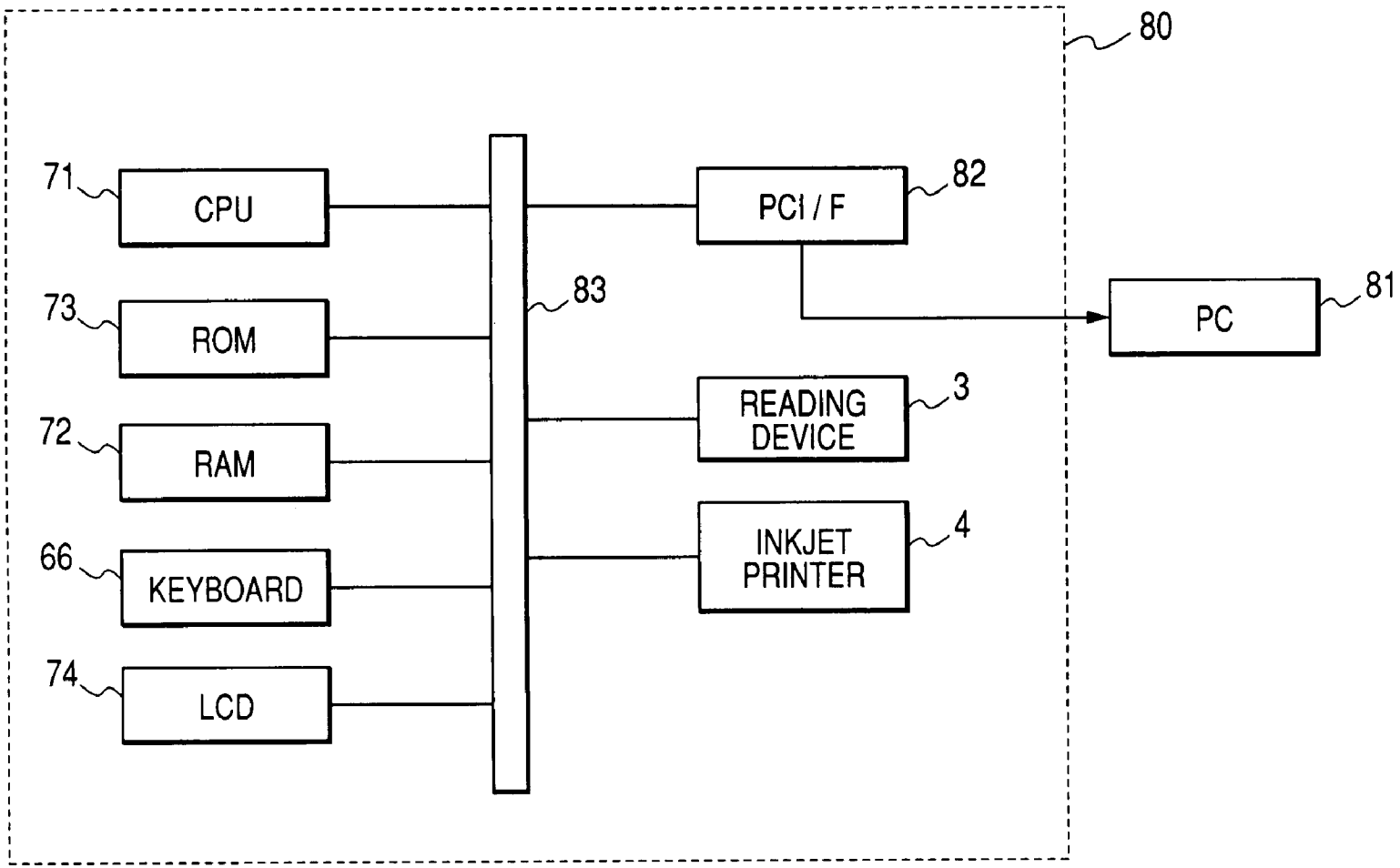
FIG. 22 is a block diagram showing an electric constitution of a multifunction machine according to a second embodiment.

As illustrated in FIG. 22, a multifunction machine (inkjet recording apparatus) 80 is provided with CPU 51, ROM 61, RAM 58, the draft reading apparatus 3, the inkjet printer 4, the keyboard 66 and LCD 74. Further, the apparatus is connected with a PC interface portion (hereinafter, referred to as "PCI/F") 82 for connecting with PC 81 via a communication cable by way of a bus 83.

CPU 51 includes the carry control portion 51, the record control portion, the logical carry amount calculating portion 54 and the quasi logical carry amount calculating portion 55 explained in the first embodiment. RAM 58 includes the logical carry amount storing portion 59 and the quasi logical carry amount storing portion 60 explained in the first embodiment. ROM 61 includes the record data generating program storing portion 62, the logical carry amount calculating equation storing portion 63 and the carry amount corresponding data storing portion 64. Further, although CPU 51, RAM 58 and ROM 61 control also other apparatus other than the inkjet printer 4 such as the draft reading apparatus 3 and therefore, strictly speaking, constitutions thereof differ from those of CPU 51, RAM 58 and ROM 61 illustrated in the first embodiment, those are attached with the same notations for convenience.

The draft reading apparatus 3 reads a sheet set to the draft reading apparatus 3 by receiving an instruction from CPU 51 and generates image data of an image thereof.

The inkjet printer 3 records the image based on the image data for the sheet set to the sheet feeding apparatus 2 by receiving an instruction from CPU 51. Here, the image is recorded on the sheet by a processing procedure similar to that explained in the first embodiment (refer to FIG. 12 through FIG. 16).

Further, there also is a case in which the multifunction machine 80 is inputted with image data from PC 81. When image data is inputted from PC 81, CPU 51 transmits an instruction of recording an image to the inkjet printer 80. The inkjet printer 3 records the image based on the image data to the sheet set to the sheet feeding apparatus 2 by receiving the instruction instructing to record the image. Further, also in this case, the image is recorded on the sheet by a processing procedure similar to that explained in the first embodiment (refer to FIG. 12 through FIG. 16).

Although an explanation has been given of the first embodiment and the second embodiment as described above, the invention is not limited to the above-described embodiments but designs thereof can variously be changed. For example, although according to the above-described embodiments, an explanation has been given of the case in which a difference between the first quasi carry amount P1 and the second quasi carry amount P2 becomes 1 which is the smallest value, the invention is not limited thereto. For example, even when the difference between the first quasi carry amount P1 and the second quasi carry amount P2 is 2, in the case in which the unit carrying resolution X is sufficiently fine, an effect equivalent to that of the embodiment can be achieved. That is, when the difference between the first quasi carry amount P1 and the second quasi carry amount P2 is set to n, so far as X/n is highly fine in contrast to the visibility limit resolution W, an effect of the invention can be obtained. Further, even when a larger number of quasi carry amounts are selected randomly such as a third quasi carry amount P3 or a fourth quasi carry amount P4 other than the first quasi carry amount P1 and the second quasi carry amount P2, so far as the unit carrying resolution X is sufficiently fine, an effect equivalent to that of the above-described embodiments can be attained. However, it is naturally the best that the difference between the first quasi carry amount P1 and the second quasi carry amount P2 is 1.

That is, it is preferable that the difference between the first quasi carry amount P1 and the second quasi carry amount P2 is the unit carrying amount. In this way, a difference among the plurality of quasi logical carry amounts can be minimized. The difference is sensed as an error in an accuracy of carrying the sheet in the sub-scanning direction and therefore, minimizing the difference signifies that deterioration in the error can be reduced as less as possible and other trade-off factor can be minimized.

Further, although according to step 152 in the second mode of the above-described embodiments, it is determined whether the carry amount T by which the sheet is to be carried is smaller than the second quasi logical carry amount P2, when smaller, the set carry amount R is set with the first quasi carry amount P1 (step 153), when larger, the set carry amount R is set with the second quasi carry amount P2 (step 154), the invention is not limited thereto. For example, the invention may be executed such that at step 152, it is determined whether the carry amount T by which the sheet is to be carried is smaller than the logical carry amount P, when smaller, the set carry amount R is set with the first quasi carry amount P1 at step 153, and when larger, the set carry amount R is set with the second quasi carry amount P2 at step 154. Further, the invention may be executed such that at step 152, it is determined whether the carry amount T by which the sheet is to be carried is larger than the first quasi carry amount P1, when larger, the set carry amount R is set with the first quasi carry amount P1 at step 153, and when smaller, the set carry amount R is set with the second quasi carry amount P2 at step 154. In either of the above-described cases, the difference S between the carry amount T by which the sheet is to be carried and the set carry amount R does not exceed 1 [pulse].

Further, although according to the above-described embodiments, the difference S between the carry amount T by which the sheet is to be carried and the set carry amount R is calculated at each time of carrying the sheet by one time (refer to step 158), the invention is not limited thereto. For example, a difference between a carry amount by which a sheet is to be carried and a carry amount by which the sheet is actually carried may be calculated at a predetermined number of times at each time of carrying the sheet by the predetermined number of times and a carry amount by way which the sheet is to be carried may be calculated in carrying the sheet at a succeeding time and thereafter based on the difference.

Next, an explanation will be given of an effect achieved by the multifunction machine 1, 80 according to the above-described embodiments.

The inkjet printers 4, 70 according to the above-described embodiments are controlled such that the sheet is carried by either of the plurality of quasi logical carry amounts P1, P2 including the natural number P2 larger than the logical carry amount P and the natural number P1 smaller than the logical carry amount P and the sheet is recorded at each time of carrying the sheet. Further, the carry amount of the sheet is determined to either of the quasi logical carry amounts of P1 or P2 such that the difference S between the carry amount by which the sheet is assumed to be carried by the logical carry amount P and the actual carry amount of the record medium R does not exceed 1 (unit carry amount). Therefore, the sheet can be recorded even when the recording resolution d is not set to a multiple of the unit carrying resolution X of the encoder 67. As a result, high image quality recording can be realized without using an encoder at high cost having a high resolution and without considerably reducing a recording speed.

Further, according to the inkjet printers 4, 70 according to the above-described embodiments, the plurality of quasi logical carry amounts P1, P2 are set to the smallest natural number P2 larger than the logical carry amount P and the largest natural number P1 smaller than the logical carry amount and therefore, a difference between the quasi logical carry amount P1 and the quasi logical carry amount P2 can be minimized. Therefore, a higher image quality recording can be realized.

Further, according to the inkjet printers 4, 70 of the above-described embodiments, only when the logical carry amount P is not a natural number, the sheet is carried by either of the quasi logical carry amount P1 or the quasi logical carry amount P2, and when the logical carry amount P is a natural number, a sheet is carried by the logical carry amount P. Therefore, the image quality can be prevented from being deteriorated when the logical carry amount P is a natural number.

Further, according to the inkjet printer 70 of the above-described embodiments, ROM 73 is stored with a plurality of logical carry amounts P in a related manner to the recording resolutions d and previously stored with the quasi logical carry amounts P1, P2 for the logical carry amount P of a nonnatural number. Therefore, a load of calculating the logical carry amount P and the quasi logical carry amounts P1, P2 can be alleviated.

Further, when the recording resolution d is inputted from the keyboard 66, the inkjet printer 4 according to the above-described embodiments calculates the logical carry amount P in accordance with the inputted recording resolution d and calculates the quasi logical carry amounts P1, P2 in accordance with the inputted recording resolution d when the calculated logical carry amount is a nonnatural number. Therefore, a sheet can be recorded not only by the recording resolution d stored to default but also by an arbitrary one of the recording resolution d.

Further, the inkjet printer 4 according to the above-described embodiments determines whether the recording resolution d for the logical carry amount P which is a natural number is equal to or larger than 5,000[dpi], and permits to record the sheet only when the recording resolution d is determined to be equal to or larger than 5,000 [dpi]. Therefore, low image quality recording can be prevented from being executed. The inkjet printer 4 according to the invention uses an encoder having a resolution of 7,000[dpi] which is equal to or smaller than a distance corresponding to the visibility limit resolution. Therefore, even when the sheet is carried by either of the first quasi logical carry amount P1 and the second quasi logical carry amount P2, low image quality recording can be prevented from being executed.

The multifunction machine 1 of the above-described embodiment refers to a method of printing by increasing the recording resolution d in the sub-scanning direction by dividing a single piece of the main scanning line data L in the dot data by a plurality of pieces (5 pieces in the above-described embodiment) of the divided line data L1 through L5 and forming lines corresponding to respectives thereof on the sheet. That is, in comparison with the case of forming a single piece of line on the recorded medium for each piece of line data L, a region of arranging dots (record pixels) in the sub-scanning direction is increased. Thereby, even when positions of the dots are shifted in the sub-scanning direction, a gap is difficult to be produced between the dots. As a factor of shifting the dots in the sub-scanning direction, there are pointed out an accuracy of fabricating the nozzle pitch, an accuracy of a direction of delivering ink, an accuracy of scanning the recording head, an accuracy of carrying the record medium and the like. The factors emerge as noise which cannot be controlled by individual machines, individual scanning timings and the like and therefore, the shift of the recording position of the dot in the sub-scanning direction can be displayed as a probability of placing the dot as shown by FIG. 17A.

Therefore, it is known that probability distributions densely overlap and a probability of producing a region at which dots are not overlapped becomes lower in the case of the high recording resolution in the sub-scanning direction as shown by FIG. 17C in comparison with the case in which the recording resolution in the sub-scanning direction is low as shown by FIG. 17B. When the probability of placing the dot becomes 0, it signifies that a color of a matrix of the record medium is necessarily thin at the region and therefore, that the probability distributions of placing the dots are densely overlapped as described above indicates that a white streak is difficult to be seen.

According to the above-described embodiment, a single piece of the main scanning line data L is divided into 5 pieces of divided line data L1 through L5, and the lines corresponding to the respectives thereof are formed on the record medium and therefore, the recording resolution in the sub-scanning direction is multiplied by 5. Therefrom, the probability of producing the white streak can be made to be low. Further, by taking an arbitrary value (for example, 2, 3, 4, 5, 6, 7, 8, 9, 10 . . . ) for N, the effect can be achieved by a desired amount.

Therefrom, it seems that it is known to be able to improve the image quality as desired by setting an arbitrary sub-scanning resolution.

Although the invention has been described according to the above-described embodiments, the invention is not limited thereto. Various embodiments without deviating from the sprint and the range of the invention can be embodied.

What is claimed is:

1. An inkjet recording apparatus comprising:

a recording head having a nozzle row aligned with a plurality of nozzles for ejecting ink;

a carrying mechanism configured to carry a record medium by a multiple of an arbitrary natural number of a unit carrying amount in a direction in parallel with the nozzle row;

a logical carry amount obtaining unit that obtains a logical carry amount based on a recording resolution along the direction in parallel with the nozzle row and a number of nozzles that are used for recording in the nozzle row and is indicated as a multiple of the unit carrying amount;

a carry controlling unit that controls the carrying mechanism such that the record medium is carried by any of a plurality of quasi logical carry amounts including a natural number larger than the logical carry amount, and a natural number smaller than the logical carry amount; and a recording head controlling unit that controls the recording head such that the record medium is recorded at each time of carrying the record medium by the carrying mechanism that is controlled by the carry controlling unit;

wherein the carry controlling unit determines a carry amount of the record medium by the carrying mechanism from the plurality of quasi logical carry amounts such that a difference between a carry amount when the record medium is assumed to be carried by the logical carry amount and an actual carry amount of the record medium does not exceed a predetermined value.

2. The inkjet recording apparatus according to claim 1, wherein the plurality of quasi logical carry amounts include a smallest natural number larger than the logical carry amount and a largest natural number smaller than the logical carry amount.

3. The inkjet recording apparatus according to claim 1, wherein the predetermined value is the unit carrying amount.

4. An injket recording apparatus comprising:

a recording head having a nozzle row aligned with a plurality of nozzles for ejecting ink;

a carrying mechanism configured to carry a record medium by a multiple of an arbitrary natural number of a unit carrying amount in a direction in parallel with the nozzle row;

a logical carry amount obtaining unit that obtains a logical carry amount based on a recording resolution along the direction in parallel with the nozzle row and a number of nozzles that are used for recording in the nozzle row and is indicated as multiple of the unit carrying amount;

a carrying controlling unit that controls the carrying mechanism such that the record medium is carried by any of a plurality of quasi logical carry amounts including a natural number larger than the logical carry amount, and a natural number smaller than the logical carry amount; and a recording head controlling unit that controls the recording head such that the record medium is recorded at each time of carrying the record medium by the carrying mechanism that is controlled by the carry controlling unit;

wherein the carry controlling unit determines a carry amount of the record medium by the carrying mechanism from the plurality of quasi logical carry amounts such that a difference between a carry amount when the record medium is assumed to be carried by the logical carry amount and an actual carry amount of the record medium does not exceed a predetermined value;

wherein the carry controlling unit controls the carrying mechanism such that the record medium is carried by any of the plurality of quasi logical carry amounts only when the logical carry amount is not a natural number and controls the carrying mechanism such that the record medium is carried by the logical carry amount when the logical carry amount is a natural number.

5. An inkjet recording apparatus comprising:

a recording head having a nozzle row aligned with a plurality of nozzles for ejecting ink;

a carrying mechanism configured to carry a record medium by a multiple of an arbitrary natural number of a unit carrying amount in a direction in parallel with the nozzle row;

a logical carry amount obtaining unit that obtains a logical carry amount based on a recording resolution along the direction in parallel with the nozzle row and a number of nozzles that are used for recording in the nozzle row and is indicated as a multiple of the unit carrying amount;

a carry controlling unit that controls the carrying mechanism such that the record medium is carried by any of a plurality of quasi logical carry amounts including a natural number larger than the logical carry amount, and a natural number smaller than the logical carry amount; and a recording head controlling unit that controls the recording head such that the record medium is recorded at each time of carrying the record medium by the carrying mechanism that is controlled by the carry controlling unit;

wherein the carry controlling unit determines a carry amount of the record medium by the carrying mechanism from the plurality of quasi logical carry amounts such that a difference between a carry amount when the record medium is assumed to be carried by the logical carry amount and an actual carry amount of the record medium does not exceed a predetermined value; further comprising:

a logical carry amount storing unit stored with each of a single or a plurality of the logical carry amounts in a related manner to the recording resolution; and a quasi logical carry amount storing unit stored with the plurality of quasi logical carry amounts for the single or the plurality of logical carry amounts stored to the logical carry amount storing unit which is not a natural number.

6. An inkjet recording apparatus comprising:

a recording head having a nozzle row aligned with a plurality of nozzles for ejecting ink;

a carrying mechanism configured to carry a record medium by a multiple of an arbitrary natural number of a unit carrying amount in a direction in parallel with the nozzle row;

a logical carry amount obtaining unit that obtains a logical carry amount based on a recording resolution along the direction in parallel with the nozzle row and a number of nozzles that are used for recording in the nozzle row and is indicated as a multiple of the unit carrying amount;

a carry controlling unit that controls the carrying mechanism such that the record medium is carried by any of a plurality of quasi logical carry amounts including a natural number larger than the logical carry amount, and a natural number smaller than the logical carry amount; and a recording head controlling unit that controls the recording head such that the record medium is recorded at each time of carrying the record medium by the carrying mechanism that is controlled by the controlling unit;

wherein the carry controlling unit determines a carry amount of the record medium by the carrying mechanism from the plurality of quasi logical carry amounts such that a difference between a carry amount when the record medium is assumed to be carried by the logical carry amount and an actual carry amount of the record medium does not exceed a predetermined value; further comprising:

a logical carry amount calculating unit that calculates the logical carry amount corresponding to the recording resolution when the recording resolution is provided; and a quasi logical carry amount calculating unit that calculates the quasi logical carry amount corresponding to the recording resolution when the logical carry amount calculated by the logical carry amount calculating unit is not a natural number.

7. An inkjet recording apparatus comprising:

a recording head having a nozzle row aligned with a plurality of nozzles for ejecting ink;

a carrying mechanism configured to carry a record medium by a multiple of an arbitrary natural number of a unit carrying amount in a direction in parallel with the nozzle row;

a logical carry amount obtaining unit that obtains a logical amount based on a recording resolution along the direction in parallel with the nozzle row and a number of nozzles that are used for recording in the nozzle row and is indicated as a multiple of the unit carrying amount;

a carry controlling unit that controls the carrying mechanism such that the record medium is carried by any of a plurality of quasi logical carry amounts including a natural number larger than the logical carry amount, and a natural number smaller than the logical carry amount; and a recording head controlling unit that controls the recording head such that the record medium is recorded at each time of carrying the record medium by the carrying mechanism that is controlled by the carry controlling unit;

wherein the carry controlling unit determines a carry amount of the record medium by the carrying mechanism from the plurality of quasi logical carry amounts such that a difference between a carry amount when the record medium is assumed to be carried by the logical carry amount and an actual carry amount of the record medium does not exceed a predetermined value; wherein the unit carry amount is equal to or smaller than a distance corresponding to a visibility limit resolution.

8. A recording method for use in an inkjet recording apparatus including a recording head having a nozzle row aligned with a plurality of nozzles for ejecting ink, a carrying mechanism configured to carry a record medium by a multiple of an arbitrary natural number of a unit carry amount in a direction in parallel with the nozzle row, and a logical carry amount obtaining unit that obtains a logical carry amount based on a recording resolution along the direction in parallel with the nozzle row and a number of the nozzles that are used for recording in the nozzle row and indicates a rate relative to the unit carry amount in the carrying mechanism, the recording method comprising:

determining the logical carry amount;

carrying the record medium by a single or a plurality of times by the carrying mechanism by any of a plurality of quasi logical carry amounts including a natural number larger than the logical carry amount, and a natural number smaller than the logical carry amount; and recording the record medium by the recording head after the carrying;

wherein in the carrying, the record medium is carried by a carry amount such that a difference between a carry amount by which the record medium is assumed to be carried by the logical carry amount and an actual carry amount of the record medium does not exceed a predetermined value.

* * * * *